US006217508B1

(12) United States Patent
Ball et al.

(10) Patent No.: US 6,217,508 B1
(45) Date of Patent: Apr. 17, 2001

(54) ULTRASONIC HEARING SYSTEM

(75) Inventors: Geoffrey R. Ball, Sunnyvale; Bob H. Katz, Los Gatos, both of CA (US)

(73) Assignee: Symphonix Devices, Inc., San Jose, CA (US)

( * ) Notice: Subject to any disclaimer, the term of this patent is extended or adjusted under 35 U.S.C. 154(b) by 0 days.

(21) Appl. No.: 09/133,961

(22) Filed: Aug. 14, 1998

(51) Int. Cl.[7] ..... H04R 25/00
(52) U.S. Cl. ..... 600/25
(58) Field of Search ..... 600/25; 151/126–37; 381/68–69.2; 607/55–57

(56) References Cited

U.S. PATENT DOCUMENTS

| | | | |
|---|---|---|---|
| 3,629,521 | | 12/1971 | Puharich . |
| 4,025,732 | | 5/1977 | Traunmüller . |
| 4,419,544 | | 12/1983 | Adelman . |
| 4,982,434 | | 1/1991 | Lenhardt et al. . |
| 5,047,994 | | 9/1991 | Lenhardt et al. . |
| 5,068,832 | | 11/1991 | Kirkpatric . |
| 5,448,644 | | 9/1995 | Pfannenmuller et al. . |
| 5,456,654 | * | 10/1995 | Ball ..... 600/25 |
| 5,624,376 | | 4/1997 | Ball et al. . |
| 5,663,727 | | 9/1997 | Vokac . |

OTHER PUBLICATIONS

Abramovich, "Auditory Perception of Ultrasound in Patients with Sensorineural and Conductive Hearing Loss" Laryngology & Otology (1978) 92(10):861–867.

Armstrong, "The Cookie–Sized Concert Hall" Business Week (Dec. 2, 1996) McGraw–Hill Companies, Inc. 1 page total.

Corso et al., "Pitch–Discrimination at High Frequencies by Air– and Bone– Conduction", American Journal of Psychology (1965) 78:557–566.

Corso, "Bone–Conduction Thresholds for Sonic and Ultrasonic Frequencies" Journal of the Acoustical Society of America (1963) 35(11):1738–1743.

Deatherage et al., "A Note on the Audibility of Intense Ultrasonic Sound" Journal of the Acoustic Society of America (1954) vol. 26, p. 582.

Lenhardt et al., "Human Ultrasonic Speech Reception" Science (1991) 253:82–85.

Haeff, Perception of Ultrasound Science (1963) 139:590–592.

Ptok, Ultrasound Hearing Aid for Deaf Patients? (translated) Phoniatrie und Padaudiologie HNO (1993) 41(2):A12–A13.

Pumphrey, "Upper Limit of Frequency for Human Hearing" Nature (Sep. 30, 1950) p. 571.

Schiopu et al., "Bone Conducted Sonic and Ultrasonic Signals in Hearing Assesment" (Jan. 3, 1997) http://www.ibme.utoronto.ca/research/acoustics/nicab.htm 2 pages total.

Tonndorf et al., "High Frequency Audiometry" Ann. Otol. Rhinol. Laryngol. (1984) 93:576–582.

"Ultraspeakers" The Economist (Aug. 24, 1996) pp. 64–65.

"Norris Acoustical Heterodyne™ Technology & Hypersonic™ Sound" (May 1, 1997) http://www/atcsd.com/html/whitepaper.html 9 pages total.

* cited by examiner

*Primary Examiner*—John P. Lacyk
(74) *Attorney, Agent, or Firm*—Townsend and Townsend and Crew LLP

(57) ABSTRACT

A direct drive hearing system for providing an ultrasonic signal to a portion of the human ear. The direct drive hearing system includes an ultrasonic direct device. The device includes a housing with at least one coil coupled to the housing. Inside the housing is a magnet, which vibrates at an ultrasonic resonant frequency in direct response to an externally generated electric signal through the at least one coil. A biasing mechanism, which supports the magnet within the housing, is also provided. The magnet is free to move within the housing subject to the retention provided by the biasing mechanism. The hearing system is partially or totally implantable.

23 Claims, 22 Drawing Sheets

ULTRASONIC HEARING SYSTEM

BACKGROUND OF THE INVENTION

The present invention relates to the field of devices and methods for assisting hearing in persons and particularly to the field of transducers for producing vibrations in the inner ear.

The seemingly simple act of hearing can easily be taken for granted. Although it seems to us as humans we exert no effort to hear the sounds around us, from a physiologic standpoint, hearing is an awesome undertaking. The hearing mechanism is a complex system of levers, membranes, fluid reservoirs, neurons and hair cells which must all work together in order to deliver nervous stimuli to the brain where this information is compiled into the higher level perception we think of as sound.

In most standard texts on hearing, it has been generally reported that the upper limit of normal hearing is about 20,000 Hz. Nonetheless, since the 1950s, scientists have studied the use of high frequency applications for use with hearing impaired individuals. Surprisingly, bone-conducted ultrasonic hearing has been found capable of supporting frequency discrimination and speech detection in normal, older hearing impaired, and profoundly deaf human subjects.

Although, the mechanism that allows humans to perceive ultrasonic stimuli is not well known or understood. There are two leading hypotheses relating to how ultrasonic perception of sound may occur. The first theory involves a hair cell region at the base of the cochlea which is believed to be capable of interpreting ultrasonic signals. The second theory involves the vestibular and saccular regions that may also be capable of responding to ultrasonic stimuli. Unfortunately, the anatomy of the ear (the tympanic membrane and ossicles) is unable to deliver acoustic ultrasonic energy, perceived in the environment, to either the cochlear or vestibular regions because of the impedance mismatch of the tympanic membrane.

In U.S. Pat. No. 4,982,434 to Lenhardt et al., herein incorporated by reference for all purposes, Lenhardt et al. describes a sound-bridge for transferring ultrasonic vibratory signals to the saccule via the human skull and independent of the inner ear. Because the ultrasonic vibrations are transmitted directly to the bones of the skull, frequencies are used that are perceived by the saccule and not by the inner ear. The supersonic bone conduction (ssBC) transducer, described in Lenhardt et al., is an electric to vibration type used to apply the ultrasonic signal as ultrasonic vibration to the skull, preferably at the mastoid interface. Piezoelectric transducers are typically used in ultrasonic applications due to their high impedance in the ultrasonic range.

Unfortunately, for an ultrasonic hearing device, such as the one described in Lenhardt et al. to provide acceptable fidelity, the ultrasonic vibratory signal must be placed as close as possible to the regions of the ear which have ultrasonic frequency perception capability. The piezoelectric bone conduction system described in Lenhardt et al. requires that the signal be delivered across the skin to the skull. This type of signal transfer can result in a poor or even a lost signal. Moreover, because the ultrasonic vibration must be translated to the cochlear or vestibular regions from outside the skull, there is a substantial amount of loss of the vibratory signal, and potentially a substantial amount of distortion could be introduced in the perceived signal. Although a piezoelectric vibrator may be sufficient for use with most frequency levels, it does have limitations in the ultrasonic frequency range. For example, piezoelectric devices tend to have outputs that result in highly peaked responses which may hinder speech perception in the ultrasonic condition. Because piezoelectric materials have a crystalline composition, the devices tend to be very stiff and typically resonate at frequencies of 6 kHz or higher.

In view of these limitations, an ultrasonic direct drive hearing system is desired which can be positioned as close to the inner ear fluid as possible to stimulate the inner ear fluid (or vestibule) or as close as possible to the saccule to stimulate the saccular system with an ultrasonic signal.

SUMMARY OF THE INVENTION

The present invention provides for an ultrasonic hearing system which includes a direct drive hearing device. When used herein the term "direct drive hearing device" describes a hearing device that is attached or connected to a structure of a user so that vibration of the hearing device vibrates the structure resulting in perception of sound by the user. Typically, the direct drive hearing device is attached to a vibratory structure of the ear, such as the tympanic membrane, ossicles, oval window, or round window. However, direct drive hearing devices may also be attached to non-vibratory structures like the skull in order to stimulate hearing by bone conduction.

The ultrasonic hearing aid system of the present invention overcomes at least some of the disadvantages of the prior art. For example, the direct drive device is used to directly apply ultrasonic vibration to components of the middle or inner ear. Thus, the ultrasonic hearing system directly stimulates the inner ear fluid (or vestibule) or saccule with the ultrasonic signal. The ultrasonic hearing system can be either partially or totally implanted into the human skull. This placement allows for positioning of the ultrasonic signal as close to the inner ear fluid (vestibule) or saccule as possible, thereby avoiding the tympanic membrane and reducing the power requirements for the system. The ultrasonic hearing system also offers the user product improvements that may include better quality signal reception, improved cosmetics, and less distortion than can be delivered by a piezoelectric transducer mounted to the outside of the skull. Patients implanted with direct drive devices often report a more natural and improved signal quality than with other conventional approaches.

In one embodiment of the invention, a hearing device for providing a vibration to a portion of the human ear is provided. The device includes a housing and a magnet, where the magnet is disposed within the housing. The magnet in the device vibrates in direct response to an externally generated ultrasonic frequency electric signal which causes the housing to vibrate ultrasonically. Preferably, a biasing mechanism is provided which supports the magnet within the housing. The magnet is free to move within the housing subject to the retention provided by the biasing mechanism. The vibration is tuned to the ultrasonic frequency corresponding to a level of retention of the magnet. Thus, the ultrasonic frequency corresponds to the resiliency characteristics of the biasing mechanism. As the term is used herein, an ultrasonic frequency is a frequency of 20,000 Hz or higher.

In yet another aspect of the invention, an ultrasonic hearing system is provided. The system includes a microphone for receiving and converting an acoustic signal to an electric signal. A frequency transposition device is also provided for converting the electrical signal to an ultrasonic frequency electrical signal. The system also includes a transducer for converting the ultrasonic frequency electric signal to an ultrasonic inertial vibration. The direct drive transducer is adapted to be coupled to a component of an inner or middle ear of a human.

In yet another aspect of the invention, a process is provided for ultrasonic hearing. The process includes converting an ultrasonic frequency electrical signal to an ultrasonic inertial vibration using a transducer. The transducer is adapted to be coupled to a component of an inner or middle ear of a human.

In yet another aspect of the invention, a process for ultrasonic hearing is provided which includes receiving an acoustic signal; converting the acoustic signal to an electric signal; converting the electrical signal to an ultrasonic frequency electric signal; and converting the ultrasonic frequency to an ultrasonic inertial vibration using a direct drive transducer. The direct drive transducer is adapted to be coupled to a component of an inner or middle ear of a human.

DETAILED DESCRIPTION OF THE PREFERRED EMBODIMENTS

In the description that follows, the present invention will be described in reference to preferred embodiments. The present invention, however, is not limited to any specific embodiment. Therefore, the description the embodiments that follow is for purposes of illustration and not limitation.

In a preferred embodiment, the ultrasonic hearing system of the present invention includes a direct drive hearing device. Although, any suitable direct drive hearing device may be used in accordance with the principles of the present invention, a preferred direct drive hearing device is a floating mass transducer hearing device, similar to that described in complete detail in U.S. Pat. No. 5,624,376 to Ball et al., which is hereby incorporated by reference for all purposes. The floating mass transducer is typically attached to one of the vibrating structures (e.g., ossicles) in the middle or inner ear, which includes components of the vestibular, saccular, and cochlear systems, as well as non-vibrating structures such as components of the skull (i.e. bone conduction).

A floating mass transducer device has a "floating mass" which is a mass that vibrates in direct response to an external signal which corresponds to sound waves. The mass is mechanically coupled to a housing which may be mounted on a vibratory structure of the ear. As the mass vibrates relative to the housing, the mechanical vibration of the floating mass is transformed into a vibration of the vibratory structure allowing the user to hear.

Figure 1:
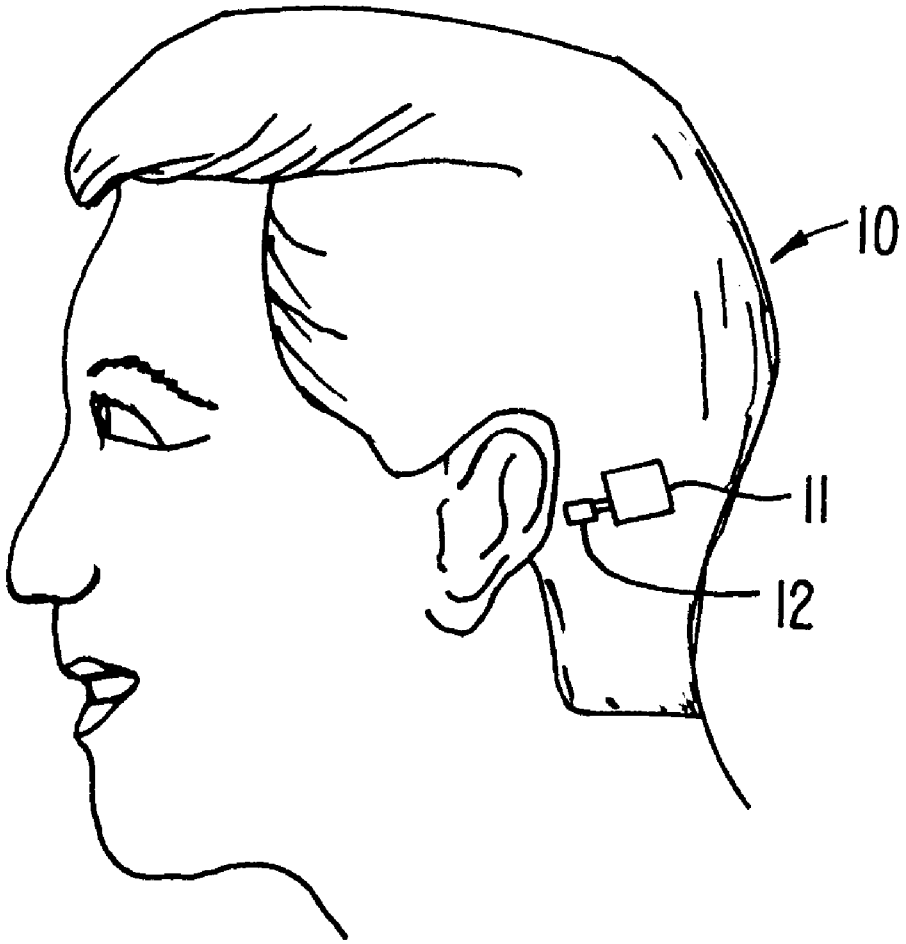
FIG. 1. (PRIOR ART)
FIG. 1 illustrates an exemplary ultrasonic piezoelectric hearing aid as described in the prior art.
Figure 2A:
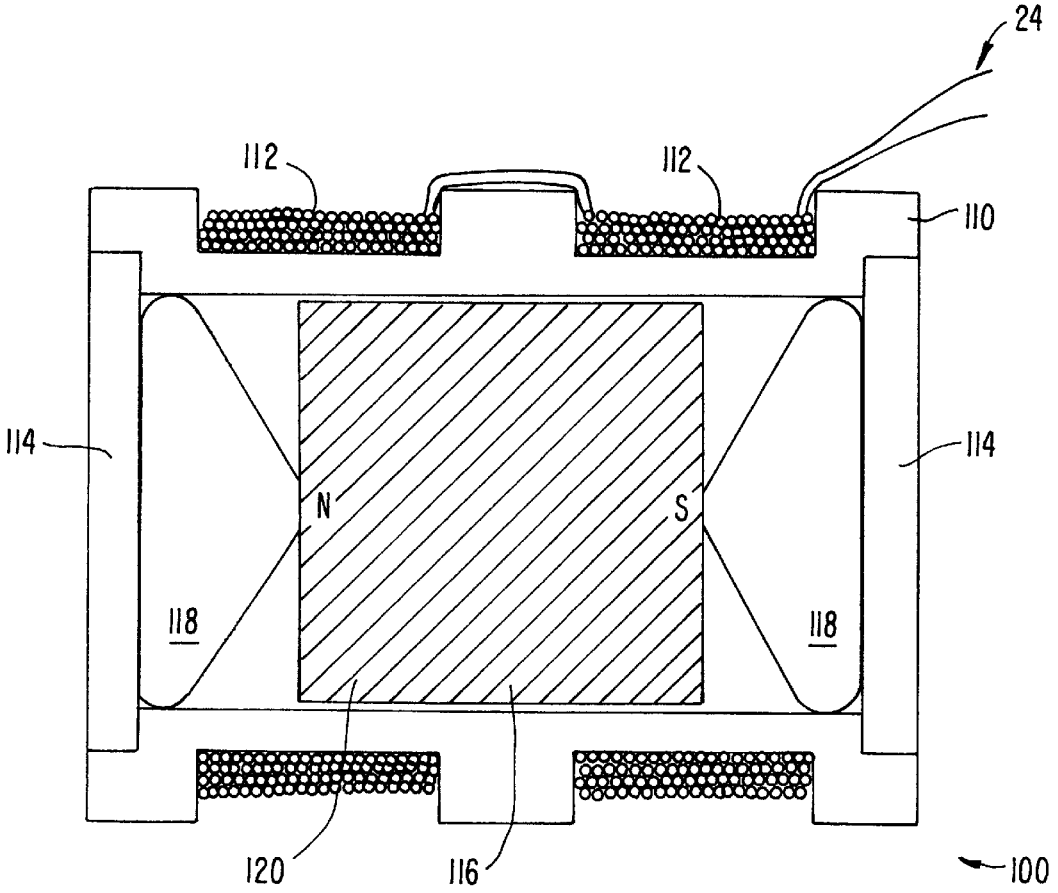
FIGS. 2A–2F illustrate a simplified cross-sectional view of preferred embodiments of floating mass transducers according to the present invention.

FIGS. 2A–2F show some preferred embodiments of the floating mass transducer, used in the present invention, incorporating a floating mass magnet. In FIG. 2A, floating mass transducer 100 has a cylindrical housing 110. The housing has a pair of notches on the outside surface to retain or secure a pair of coils 112. The coils may be made of various metallic materials including gold and platinum. The housing retains the coils much like a bobbin retains thread. The housing includes a pair of end plates 114 that seal the housing. The housing may be constructed of materials such as titanium, iron, stainless steel, aluminum, nylon, and platinum. In one embodiment, the housing is constructed of titanium and the end plates are laser welded to hermetically seal the housing.

Within the housing is a cylindrical magnet 116 which may be a SmCo magnet. The magnet is not rigidly secured to the inside of the housing. Instead, a biasing mechanism supports, and may actually suspend, the magnet within the housing. As shown, the biasing mechanism is a pair of soft silicone cushions 118 that are on each end of the magnet. Thus, the magnet is generally free to move between the end plates subject to the retention provided by the silicone cushions within the housing. Although silicone cushions are shown, other biasing mechanisms like springs and magnets may be used. More details relating to the biasing mechanisms are described below.

When an electrical signal corresponding to ambient sound passes through coils 112, the magnetic field generated by the coils interacts with the magnetic field of magnet 116. The interaction of the magnetic fields causes the magnet to vibrate within the housing. Preferably, the windings of the two coils are wound in opposite directions to get a good resultant force on the magnet (i.e., the axial forces from each coil do not cancel each other out). The magnet vibrates within the housing and is biased by the biasing mechanism within the housing.

It is known that an electromagnetic field in the vicinity of a metal induces a current in the metal. Such a current may oppose or interfere with magnetic fields. Although a thin metal layer such as titanium separates coils 112 and magnet 116, if the metal layer is sufficiently thin (e.g., 0.05 mm) then the electromagnetic interference is negligible. Additionally, the housing may be composed of a nonconducting material such as nylon. In order to reduce friction within the housing, the internal surface of the housing and/or the magnet may also be coated to reduce the coefficient of friction.

Figure 2B:
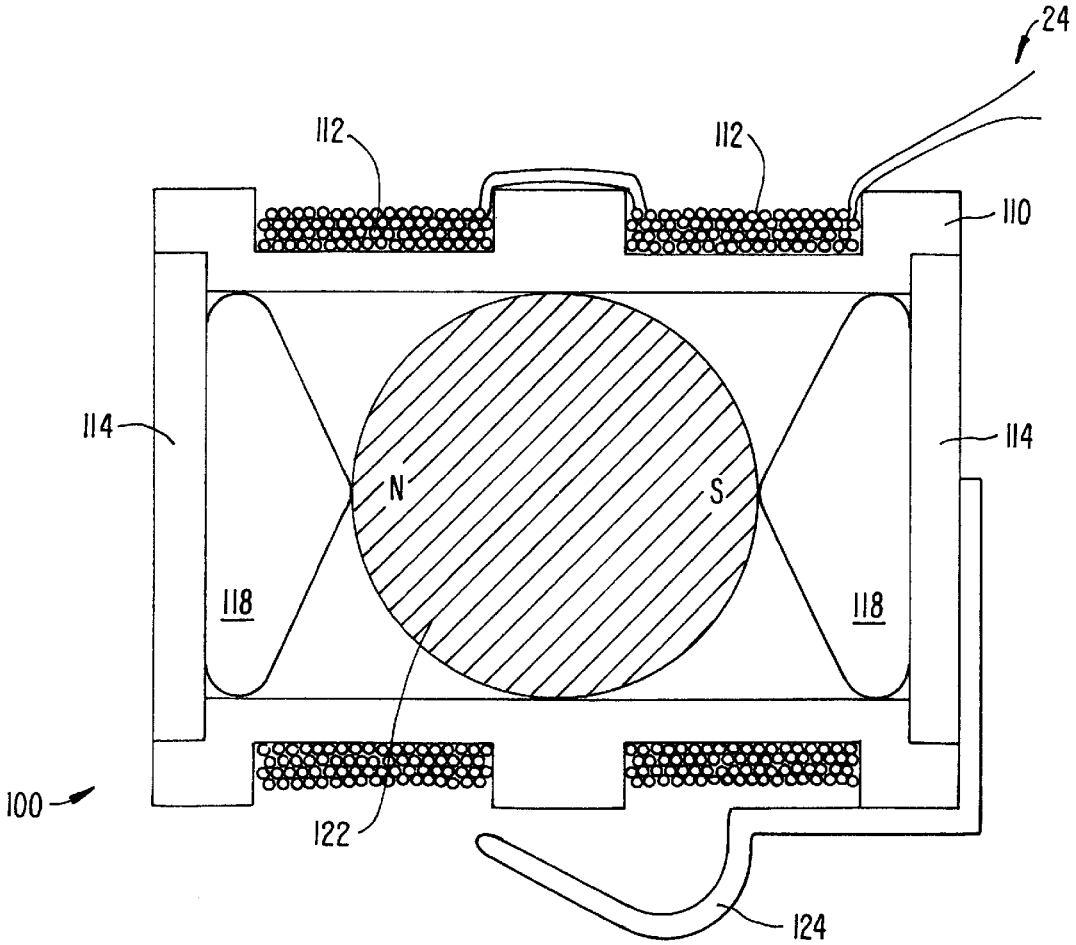

Although the friction opposing movement of the magnet within the housing may be reduced by coating the internal surface of the housing and/or magnet, FIG. 2B shows an embodiment of a floating mass transducer that has a reduced friction within the housing. The floating mass transducer is generally the same as shown in FIG. 2A except that the floating mass transducer has a spherical magnet 122 within the housing. A spherical magnet may reduce the amount of low frequency distortion caused by an edge of the cylindrical magnet catching the internal surface of the housing.

The spherical magnet may reduce friction within the housing in two ways. First, the spherical magnet has less surface area in contact with the internal surface of the housing and no edges. Second, the spherical magnet may roll within the housing which produces less friction than sliding friction. Thus, the spherical magnet may reduce friction within the housing opposing movement of the magnet.

The floating mass transducer is also shown with a clip attached to one end of the housing. The clip may be a metal clip welded to the housing to allow the transducer to be attached to an ossicle. Other attachment mechanisms may also be used.

Figure 2C:
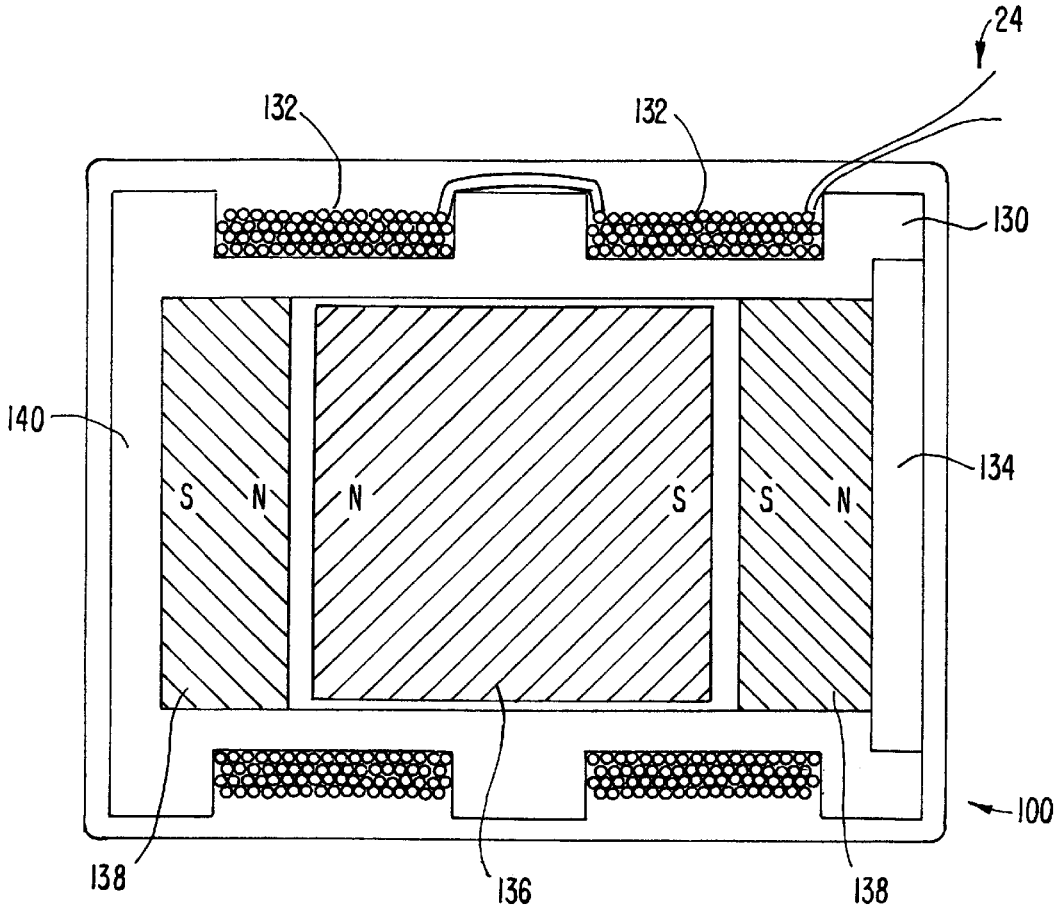

FIG. 2C shows another embodiment of a floating mass transducer with a floating mass magnet. Transducer 100 has a cylindrical housing 130 with one open end. The housing has a pair of notches on the outside surface to retain a pair of coils 132. The coils may be made of various metallic materials including gold and platinum. The housing retains the coils much like a bobbin retains thread. The housing includes an end plate 134 that seals the housing. The housing may be constructed of materials such as titanium, iron, stainless steel, aluminum, nylon, and platinum. In one embodiment, the housing is constructed of titanium and the end plate is laser welded to hermetically seal the housing.

Within the housing is a cylindrical magnet 136 which may be a SmCo magnet. The magnet is not rigidly secured to the inside of the housing. On each side of the magnet is a biasing mechanism. As shown, the biasing mechanism is a pair of magnets 138 placed within the housing so that like poles between magnets 136 and 138 are adjacent to each other. Thus, the magnet is generally free to move between magnets 138 except for the opposition provided by the magnets biasing magnet 136.

When an electrical signal corresponding to ambient sound passes through coils 112, the magnetic field generated by the coils interacts with the magnetic field of magnet 136.

The interaction of the magnetic fields causes the magnet to vibrate within the housing.

The transducer may be manufactured by placing a magnet within the housing, biasing the magnet within the housing, sealing the housing, and wrapping at least one coil around the outside surface of the housing. Biasing the magnet within the housing may include placing silicone cushions, springs, magnets, or other types of biasing mechanisms within the housing. Additionally, at least coil may be secured to an inside surface of the housing. In a preferred embodiment, the housing is hermetically sealed.

Transducer 100 is shown coated with a coating 140. The coating may be acrylic or a polyamide. Additionally, the transducer may be coating with a re-absorbable coating which reduces damage to the device resulting from handling during implantation. A re-absorbable polymer may be used such that the coating will dissolve. Thus, after the coating is absorbed, the coating does not add mass to the floating mass transducer.

Figure 2D:
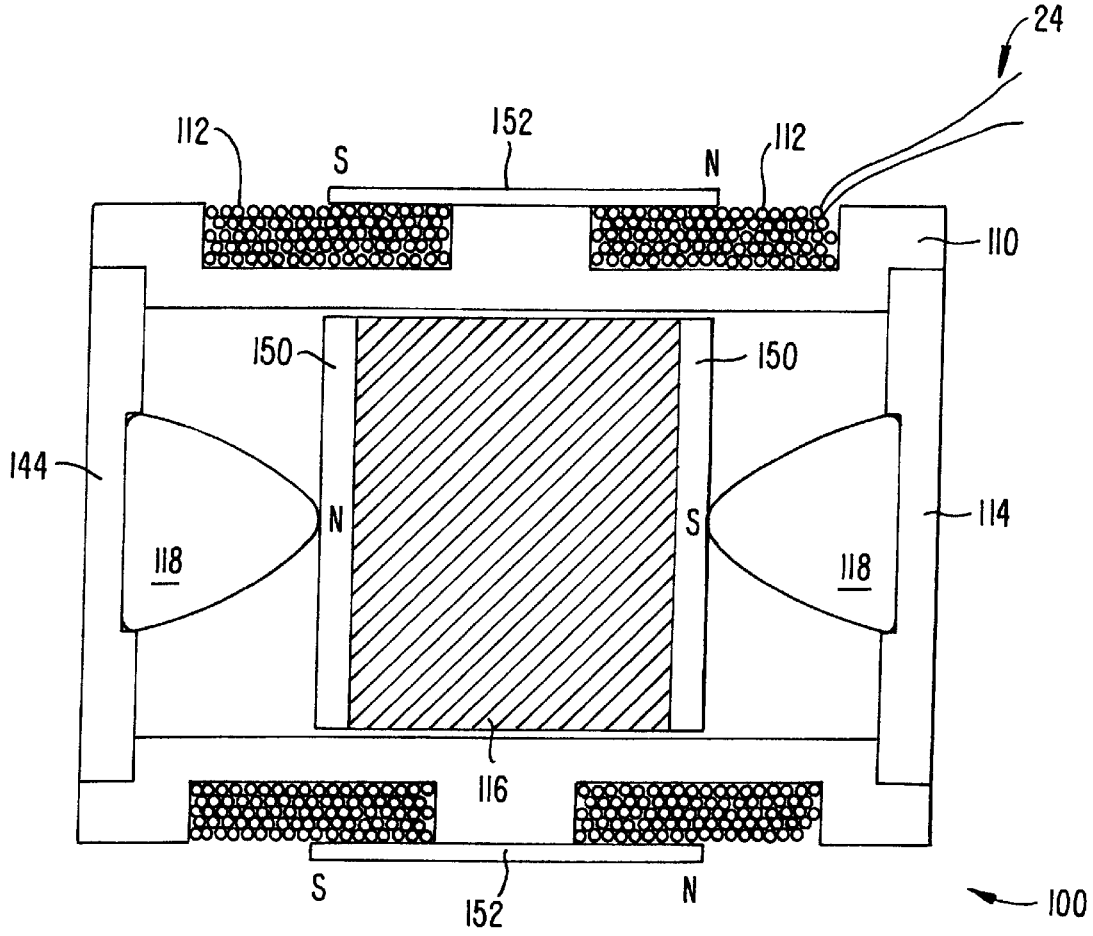

FIG. 2D shows a floating mass transducer that is the same as the transducer shown in FIG. 2A except for pole pieces 150 and tubular magnet 152. The efficiency of the floating mass transducer may be increased by increasing the magnetic flux through coils 112. Pole pieces added to the ends of magnet 116 may help redirect more of the magnetic field lines through the coils, thereby increasing the magnetic flux through the coils. The pole pieces may made of a metallic material.

Alternatively, or in addition to the pole pieces, tubular magnet 152 may be placed around the housing as shown. The poles of magnet 152 are opposite the poles of magnet 116 in order to direct more magnetic field lines through the coils, thereby increasing the magnetic flux through the coils. The tubular magnet may be a thin magnetized metallic material.

As shown in FIG. 2D, the biasing mechanism may be integrated into end plates 114. Silicone cushions 118 are placed or affixed into indentations in the end plates.

Figure 2E:
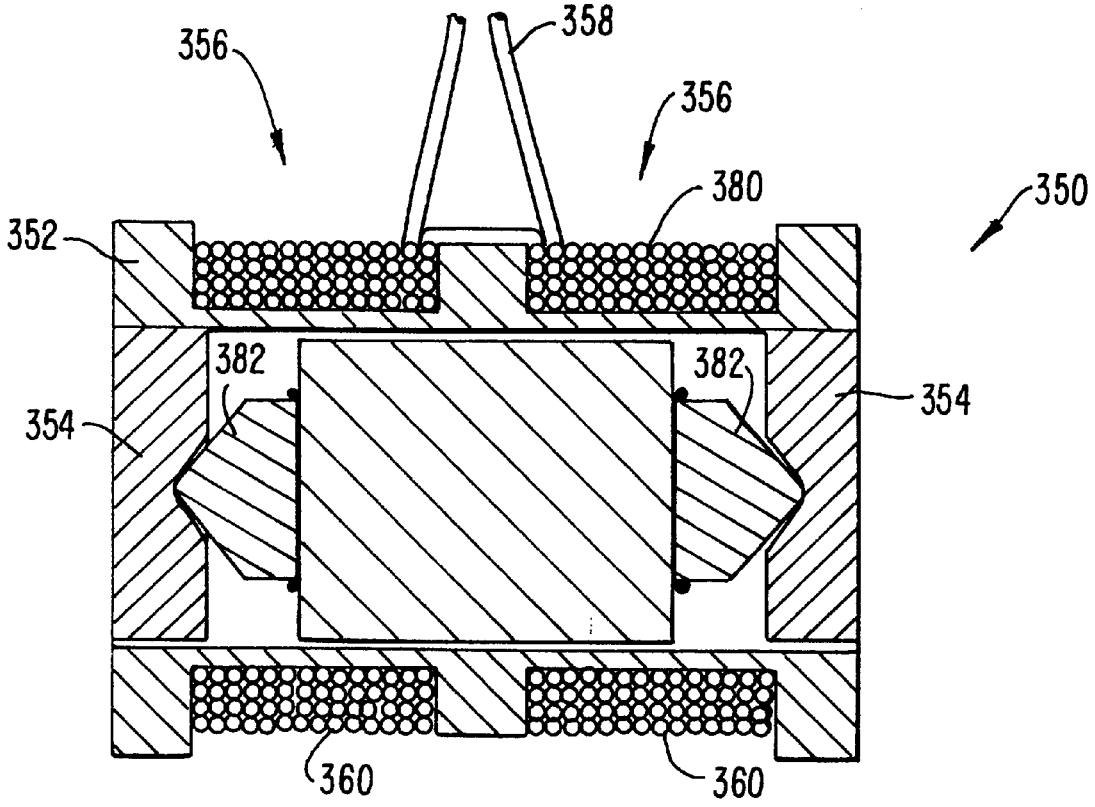

FIG. 2E is a cross-sectional view of an embodiment of a floating mass transducer 350, which includes a cylindrical housing 352 sealed by two end plates 354. In preferred embodiments, the housing is composed of titanium and the end plates are laser welded to hermetically seal the housing.

The cylindrical housing includes a pair of grooves 356. The grooves are designed to retain wrapped wire that form coils much like bobbins retain thread. A wire 358 is wound around one groove, crosses over to the other groove and is wound around the other groove. Accordingly, coils 360 are formed in each groove. In preferred embodiments, the coils are wound around the housing in opposite directions. Additionally, each coil may include six "layers" of wire, which is preferably insulated gold wire.

Within the housing is a cylindrical magnet 380. The diameter of the magnet is less than the inner diameter of the housing which allows the magnet to move or "float" within the housing. The magnet is biased within the housing by a pair of silicone springs 382 so that the poles of the magnet are generally surrounded by coils 360. The silicone springs act like springs which allow the magnet to vibrate relative to the housing resulting in inertial vibration of the housing. As shown, each silicone spring is retained within an indentation in an end plate. The silicone springs may be glued or otherwise secured within the indentations.

As is apparent when the embodiment of FIG. 2E is compared to other embodiments, the silicone springs have been inverted.

Inverted silicone springs 382 are secured to magnet 380 by, e.g., an adhesive. End plates 354 have indentations within which an end of the silicone springs are retained. In this manner, the magnet is biased within the center of the housing but not in contact with the interior surface of the housing. The process of making the floating mass transducer shown in FIG. 2E is fully described in application Ser. No. 08/816,115, which is herein incorporated by reference.

Figure 2F:
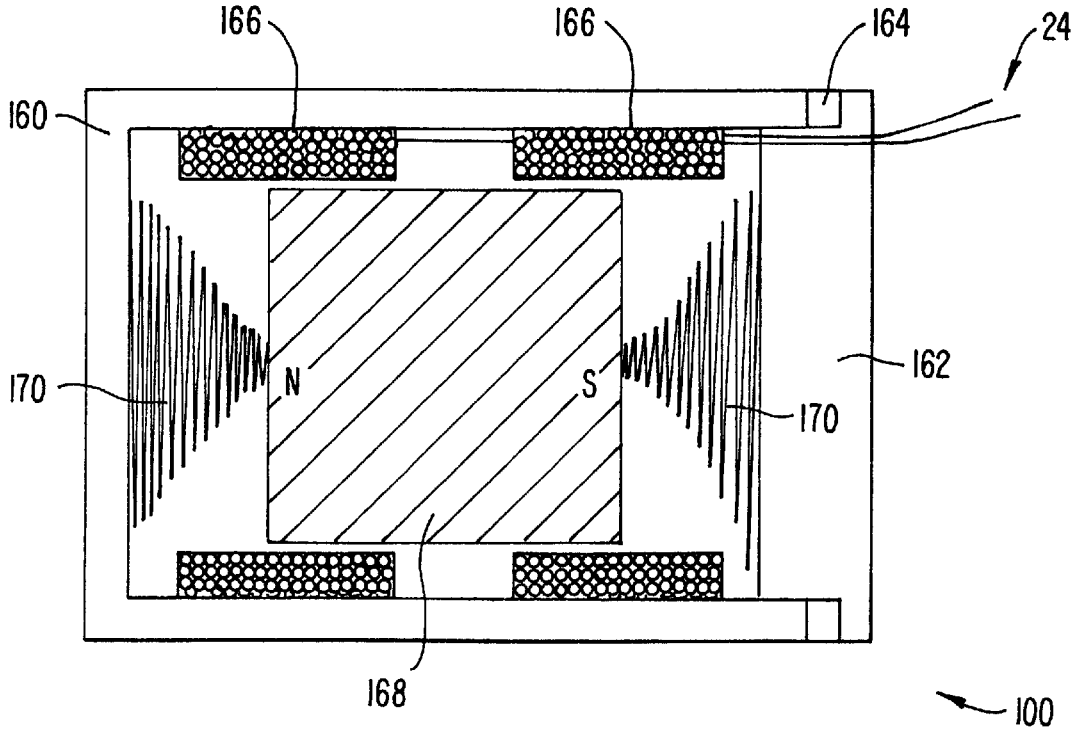

FIG. 2F shows another embodiment of a floating mass transducer with a floating mass magnet. Transducer 100 has a cylindrical housing 160 with one open end. The housing includes an end plate 162 which seals the housing by being pressed with an interference fit into the open end of the housing. A washer 164 helps seal the housing. In one embodiment, the housing, washer and end plate are gold plated so that the housing is sealed with gold-gold contacts and without being welded.

A pair of coils 166 are secured to an internal surface of the housing. A floating cylindrical magnet is also located within the housing. The magnet is not rigidly secured to the inside of the housing. On each side of the magnet is a biasing mechanism. As shown, the biasing mechanism is a pair of coil springs 170. Thus, the magnet is generally free to move side-to-side except for biasing coil springs 170. Leads 24 may run through end plate 162 as shown.

The resonant frequency of the floating mass transducer is determined by the "stiffness" by which the biasing mechanism biases the magnet. For example, if a higher resonant frequency of the floating mass transducer is desired, a mechanism with a relatively high spring force may be utilized as the biasing mechanism. Alternatively, if a lower resonant frequency of the floating mass transducer is desired, a mechanism with a relatively low spring force may be used as the biasing mechanism. In cases in which magnets are used as the biasing mechanism, the primary magnet vibrates within the housing and is biased by the biasing mechanism within the housing. In this embodiment, if a higher resonant frequency of the floating mass transducer is desired, magnets 138 may be placed in close proximity to magnet 136. Alternatively, if a lower resonant frequency of the floating mass transducer is desired, magnets 138 may be placed farther from magnet 136 (FIG. 2C).

Two primary spring characteristics affect the resonant frequency of a particular floating mass transducer: the spring constant and the damping factor. A high spring constant stiffens the spring-mass system, leading to a high resonance frequency. A high damping factor lowers the amplitude of the resonance peak and slightly increases the resonance frequency.

The following design parameters are used to determine the resonant frequency provided by the biasing mechanisms. The material of the biasing mechanism contributes substantially to resonance tuning. The biasing mechanism can be made of an elastomeric material, which is a highly resilient material and provides a high spring constant and a low damping ratio. Generally, a typical combined dynamic spring force for an ultrasonic frequency capable elastomeric biasing mechanism may range from between about 100 kN/m and about 500 kN/m, preferably about 200 kN/m. Different elastomers of varying spring constants and damping ratios may be used, for example, filled and unfilled silicone, urethane, and natural latex rubber.

Biasing mechanism height also affects the spring constant and the damping ratio. Generally, a short spring will have a relatively high spring constant and a relatively low damping ratio. A preferred height for a elastomeric biasing mechanism suited for ultrasonic tuning of the frequency is between about 0.1 mm and about 0.5 mm, preferably about 0.35 mm. A spring pre-load will also increase the resonance frequency of the FMT by increasing the effective spring constant. For example, a pre-load on the biasing mechanism of between about 0.01 N-s/m and about 1 N-s/m per biasing mechanism is suitable for ultrasonic tuning of the FMT. The shape of the biasing mechanism will also dictate a value for the spring constant. Biasing mechanisms with narrow cross-sections will generally have lower spring constants than those with thick cross-sections. For example, a conical shaped biasing mechanism has a higher resonant frequency than a narrow cylindrical shaped biasing mechanism. Preferred, shapes for ultrasonic tuning of the FMT include cones, cylinders, balls, as well as others.

Alternatively, a coil spring may be used as a biasing mechanism. The spring constant of a coil spring can be chosen to set the resonant frequency of an FMT to a particular value, preferably in the range of ultrasonic frequencies. The pitch, length, coil diameter, wire diameter, and number of active coils all combine to determine the spring constant of a coil spring. Generally, a typical combined dynamic spring force for an ultrasonic frequency capable coil spring biasing mechanism may range from between about 100 kN/m and about 500 kN/m, preferably about 200 kN/m. The spring material also contributes to the value of the spring constant. Many different wire materials may be used, for example, stainless-steel, beryllium-copper, or Nitinol®.

Figure 3:
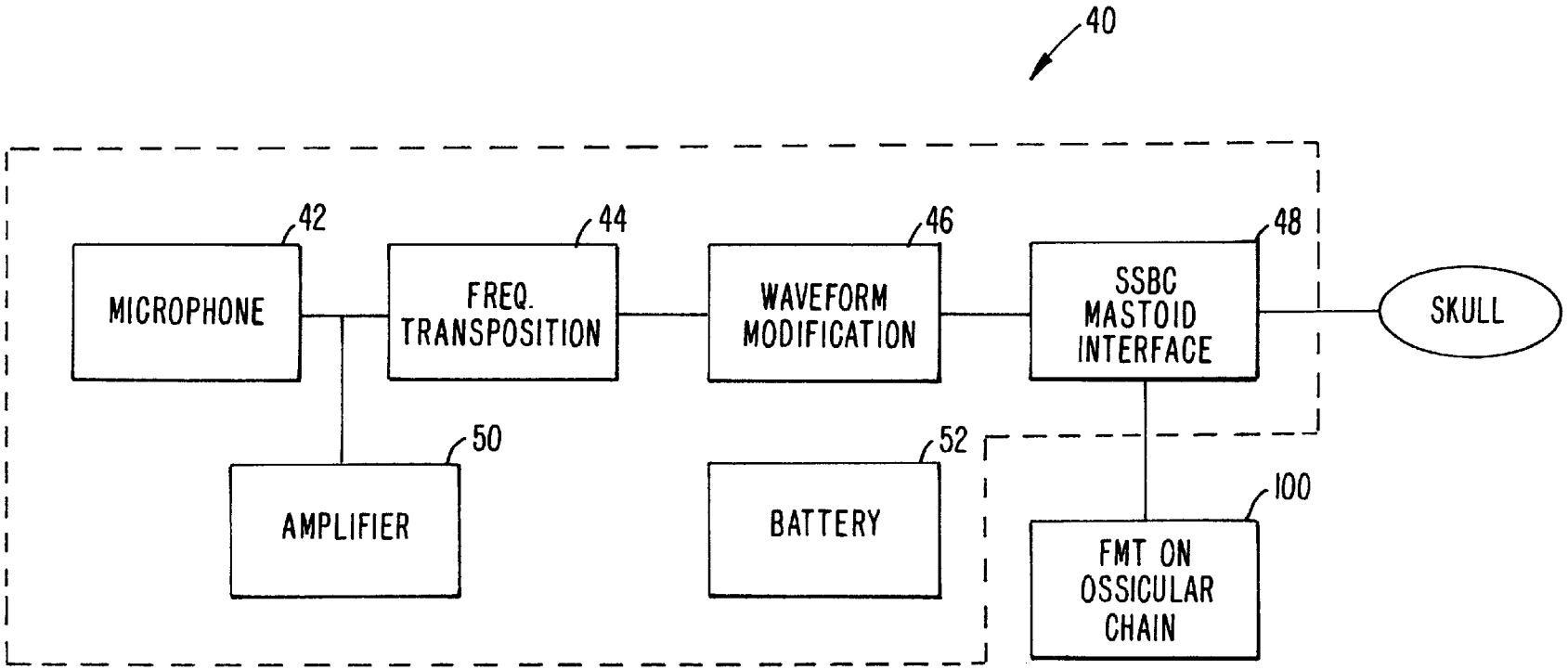
FIG. 3 illustrates a block diagram of an ultrasonic direct drive hearing device having a floating mass transducer according to the present invention.

FIG. 3 shows a block diagram of an ultrasonic external sound transducer 40. As shown, the ultrasonic external sound transducer 40 includes a microphone 42, a frequency transposition unit 44, a waveform modifier 46, and a ssBC mastoid interface 46, which is attached to a human skull. In the ultrasonic hearing aid system, ultrasonic external sound transducer 40 is electrically coupled to FMT 100, which is subsequently attached, for example, to a portion of the middle ear, skull, oval window, or round window of a human. The ultrasonic external sound transducer can also include an amplifier 50 and a battery 52.

Figure 4:
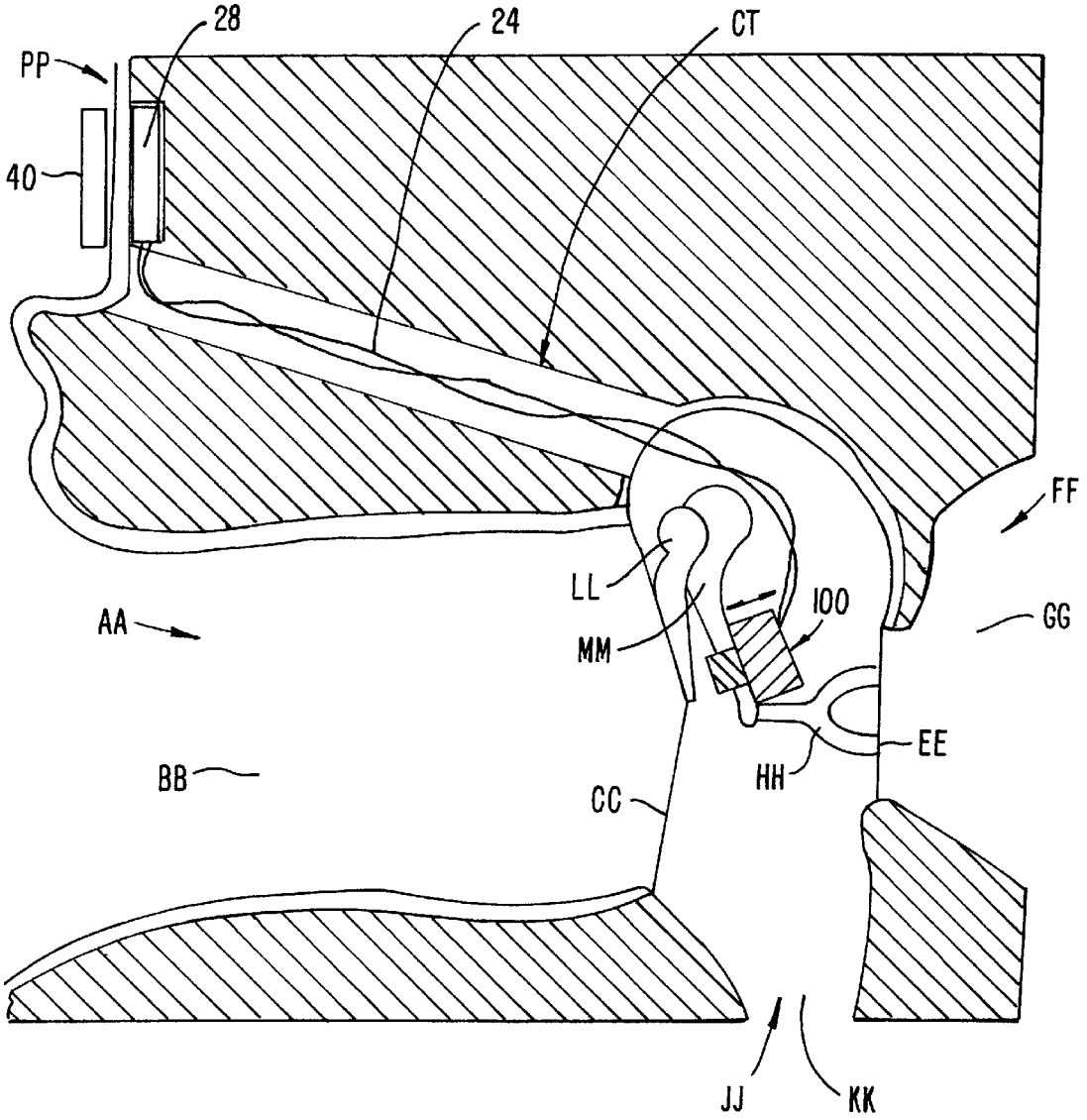
FIG. 4 shows a cross-sectional view of a user's ear having one of the implanted ultrasonic direct drive hearing devices as shown in FIGS. 2A–2F.

The elements of external sound transducer 40, are substantially identical in design to those found in most conventional hearing aid transducers, with the exception of the frequency transposition unit 44, which is used to transpose or convert the electric signal to an ultrasonic frequency signal. As shown in FIG. 4, the external sound transducer 40 is positioned on the exterior of the skull PP. A subcutaneous coil transducer 28 is connected to the leads 24 of the transducer 100 and is typically positioned under the skin behind the ear such that the external coil is positioned directly over the location of the subcutaneous coil 28.

In operation, sound waves are converted to an electrical signal by microphone 42 of external sound transducer 40. Amplifier 50 boosts the signal and delivers it to frequency transposition unit 44. The frequency conversion or transposition shifts the frequency up from a normal audiometric range to the ultrasonic range, above 20 KHZ. Leads 24 conduct the ultrasonic electric signal to FMT transducer 100 through a surgically created channel CT in the temporal bone. When the ultrasonic signal representing the sound wave is delivered to the coil in the implantable transducer 100, the magnetic field produced by the coil interacts with the magnetic field of the magnet.

As the ultrasonic current alternates, the magnet assembly and the coil alternatingly attract and repel one another. The alternating attractive and repulsive forces cause the magnet assembly and the coil to alternatingly move towards and away from each other. The magnet is retained, as described above, by the biasing mechanism of the FMT. Because the coil is more rigidly attached to the housing than is the magnet, the coil and housing move together as a single unit. The biasing mechanism of the preferred embodiment, being of a high spring constant and a low damping ratio, causes the housing to move in correspondences to the supplied ultrasonic electrical signal. The directions of the ultrasonic movement of the housing is indicated by the double headed arrow in FIG. 4. The ultrasonic vibrations are conducted via the stapes HH to the oval window EE and ultimately to the cochlear or vestibular regions, where ultrasonic hearing perception is possible.

Although the ultrasonic hearing device described above uses a tuned FMT with a biasing mechanism to cause the transducer to vibrate ultrasonically, the ultrasonic hearing system can be configured using the alternative configurations described below. Each of the following transducers will operate ultrasonically by tuning the devices to a have a peak resonance in the ultrasonic range. An efficient ultrasonic response is achieved by increasing the mechanics of the transducer system, and/or adjusting spring constants, and/or using stiffer materials.

Figure 5:
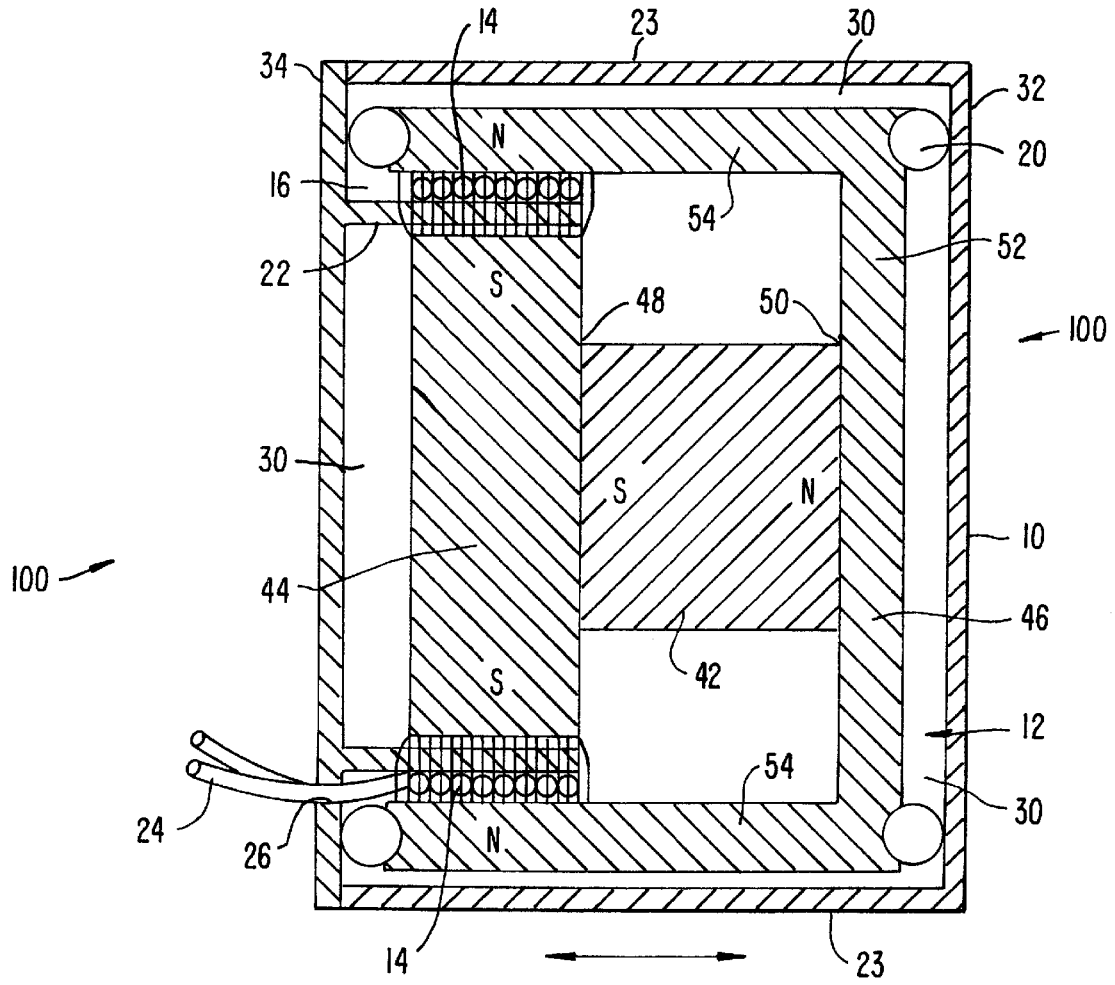
FIG. 5 is a simplified cross-sectional view of an alternative embodiment of a floating mass transducer having a floating magnet.

The structure of one embodiment of a floating mass transducer according to the present invention is shown in FIG. 5. In this embodiment, the floating mass is a magnet. The transducer 100 is generally comprised of a sealed housing 10 having a magnet assembly 12 and a coil 14 disposed inside it. The magnet assembly is loosely suspended within the housing, and the coil is rigidly secured to the housing. The magnet assembly 12 preferably includes a permanent magnet 42 and associated pole pieces 44 and 46. When alternating current is conducted to the coil, the coil and magnet assembly oscillate relative to each other and cause the housing to vibrate. The housing 10 is proportioned to be attached within the middle ear, which includes the malleus, incus, and stapes, collectively known as the ossicles, and the region surrounding the ossicles. The exemplary housing is preferably a cylindrical capsule having a diameter of about 1.5 mm and a thickness of about 2 mm, and is made from a biocompatible material such as titanium. The housing has first and second faces 32, 34 that are substantially parallel to one another and an outer wall 23 which is substantially perpendicular to the faces 32, 34. Affixed to the interior of the housing is an interior wall 22 which defines a circular region and which runs substantially parallel to the outer wall 23.

Figure 6A:
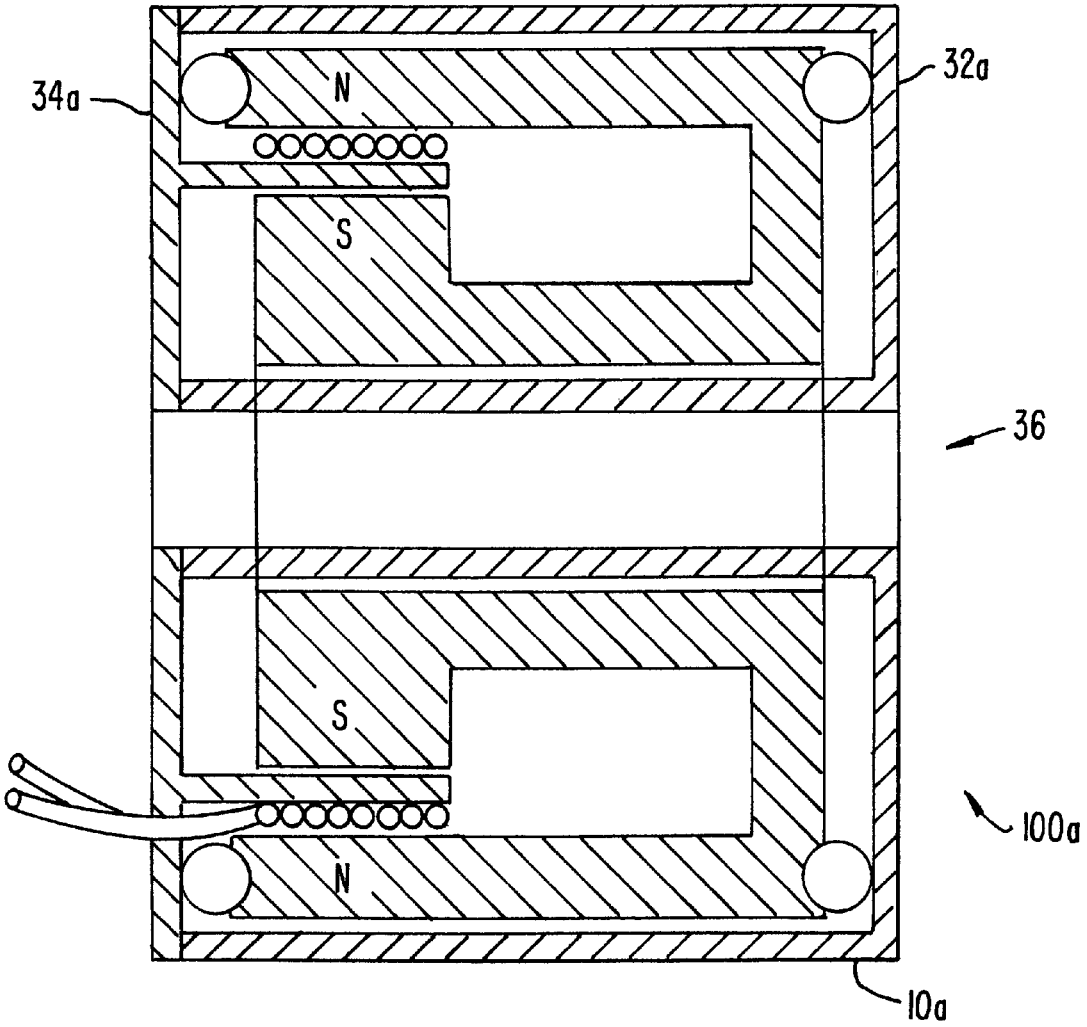
FIG. 6A is a cross-sectional side view of another embodiment of a floating mass transducer having a floating magnet.
Figure 6B:
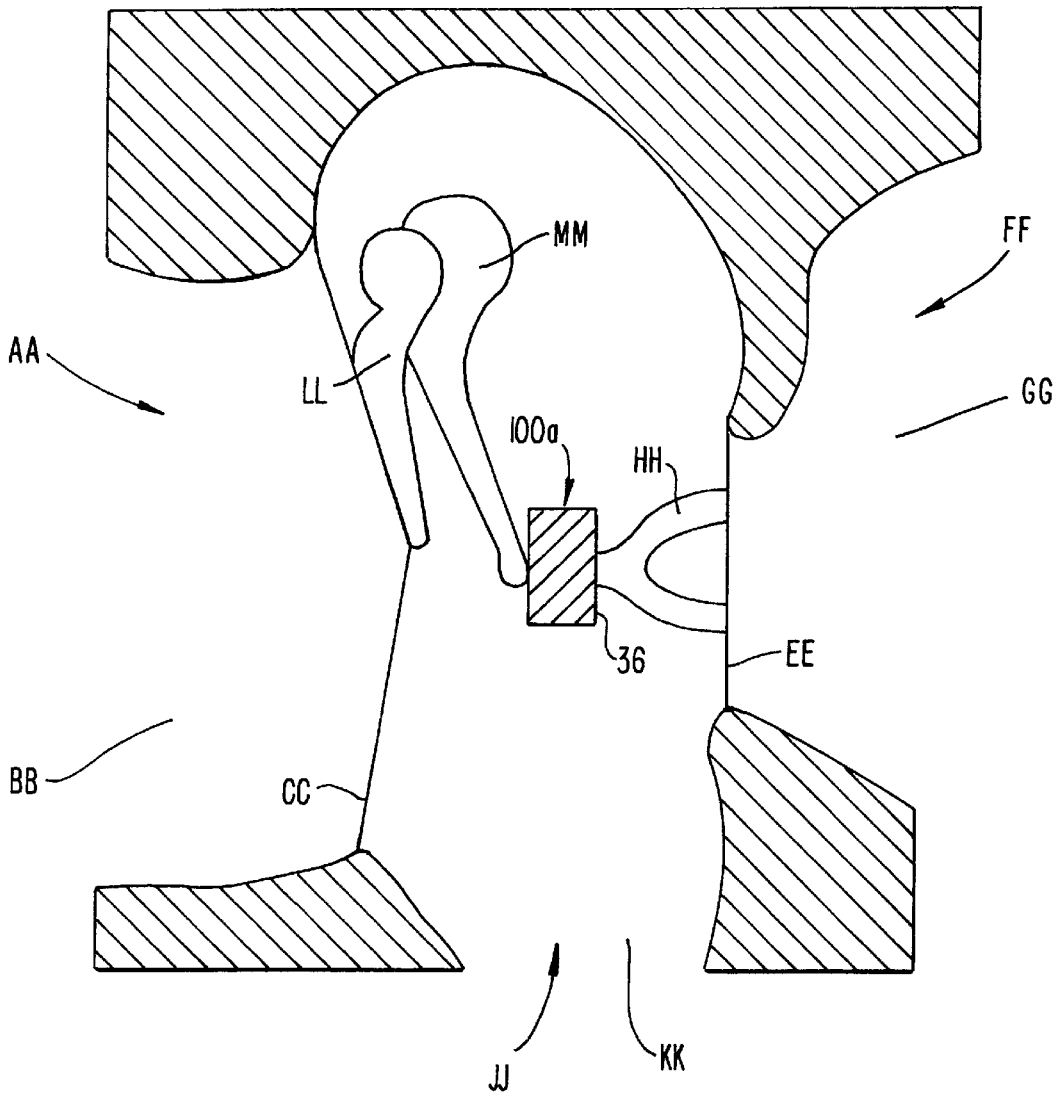
FIG. 6B is a schematic representation of a portion of the auditory system showing the embodiment of FIG. 6A positioned around a portion of a stapes of the middle ear.

An alternate transducer 100*a* having an alternate mechanism for fixing the transducer to structures within the ear is shown in FIGS. 6A and 6B. In this alternate transducer 100*a*, the housing 10*a* has an opening 36 passing from the first face 32*a* to the second face 34*a* of the housing and is thereby annularly shaped. When implanted, a portion of the stapes HH is positioned within the opening 36. This is accomplished by separating the stapes HH from the incus MM and slipping the O-shaped transducer around the stapes HH. The separated ossicles are then returned to their natural position and where the connective tissue between them heals and causes them to reconnect. This embodiment may be secured around the incus in a similar fashion.

Figure 7:
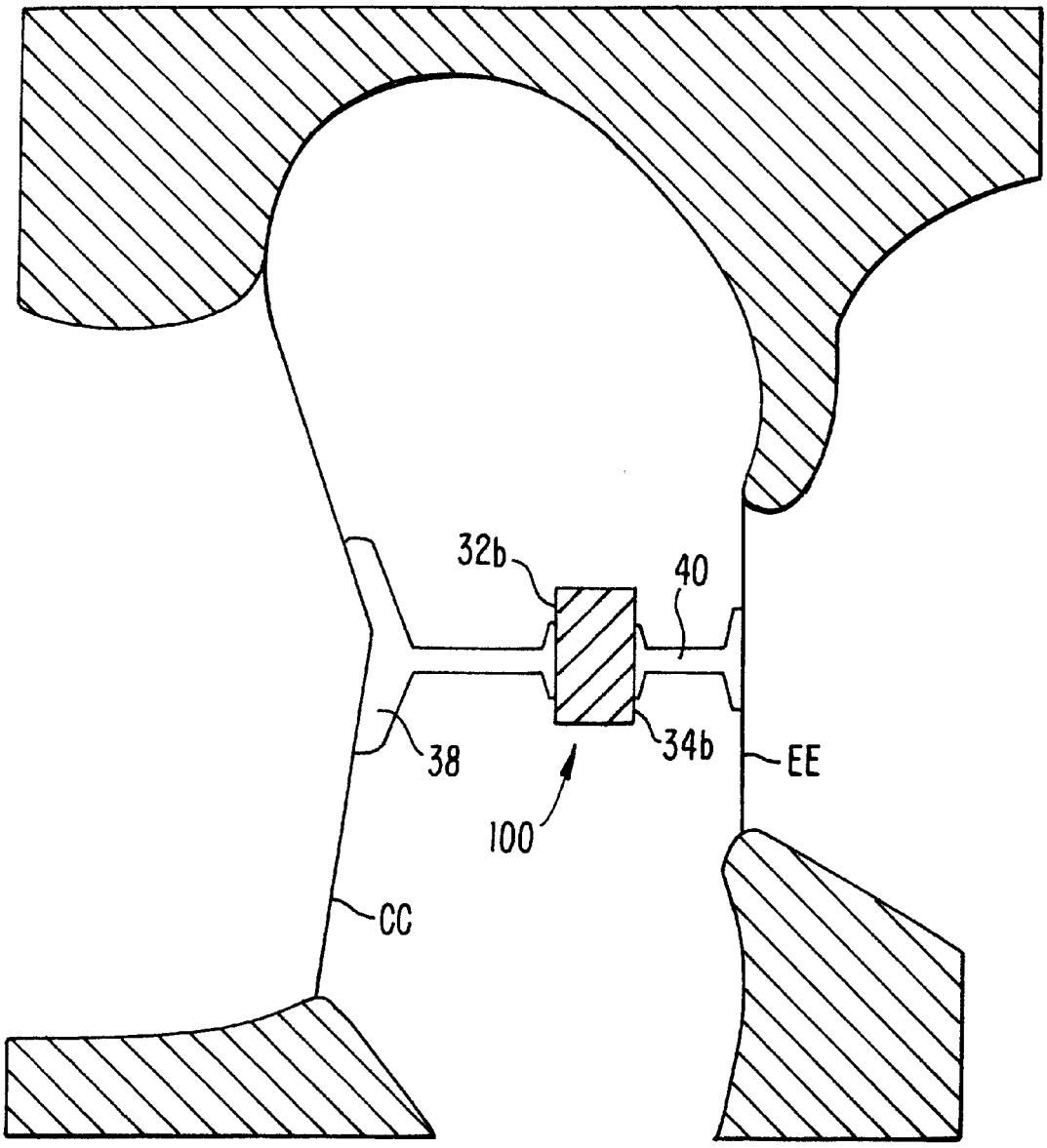
FIG. 7 is a schematic representation of a portion of the auditory system showing a floating mass transducer and a total ossicular replacement prosthesis secured within the ear.
Figure 8:
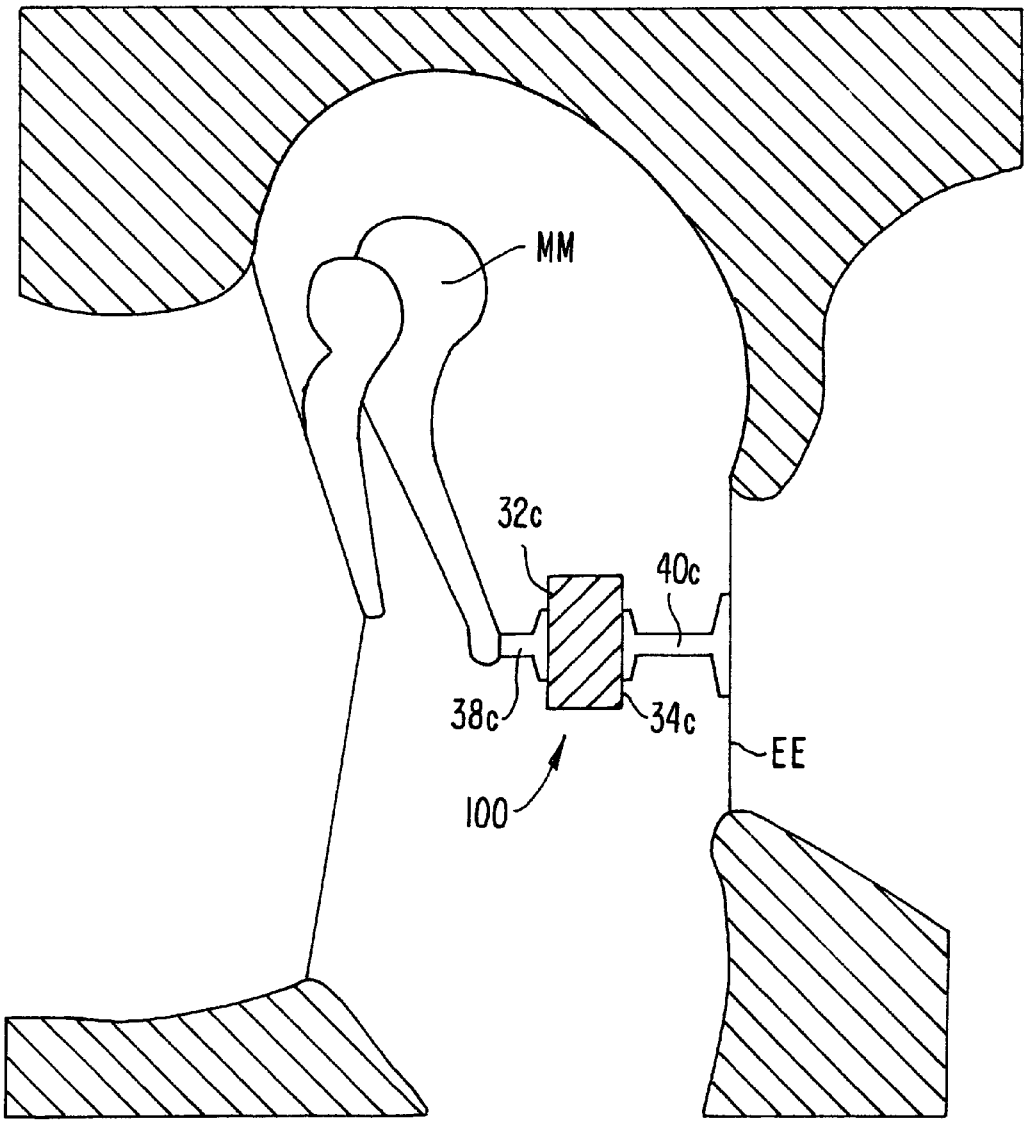
FIG. 8 is a schematic representation of a portion of the auditory system showing a floating mass transducer and a partial ossicular replacement prosthesis secured within the ear.

FIGS. 7 and 8 illustrate the use of the transducer of the present invention in combination with total ossicular replacement prostheses and partial ossicular replacement prostheses. These illustrations are merely representative; other designs incorporating the transducer into ossicular replacement prostheses may be easily envisioned.

Ossicular replacement prostheses are constructed from biocompatible materials such as titanium. Often during ossicular reconstruction surgery the ossicular replacement prostheses are formed in the operating room as needed to accomplish the reconstruction. As shown in FIG. 7, a total ossicular replacement prosthesis may be comprised of a pair of members 38, 40 connected to the circular faces 32*b*, 34*b* of the transducer 100. The prosthesis is positioned between the tympanic membrane CC and the oval window EE and is preferably of sufficient length to be held into place by friction. Referring to FIG. 8, a partial ossicular replacement prosthesis may be comprised of a pair of members 38*c*, 40*c* connected to the circular faces 32*c*, 34*c* of the transducer and positioned between the incus MM and the oval window EE.

Figure 9A:
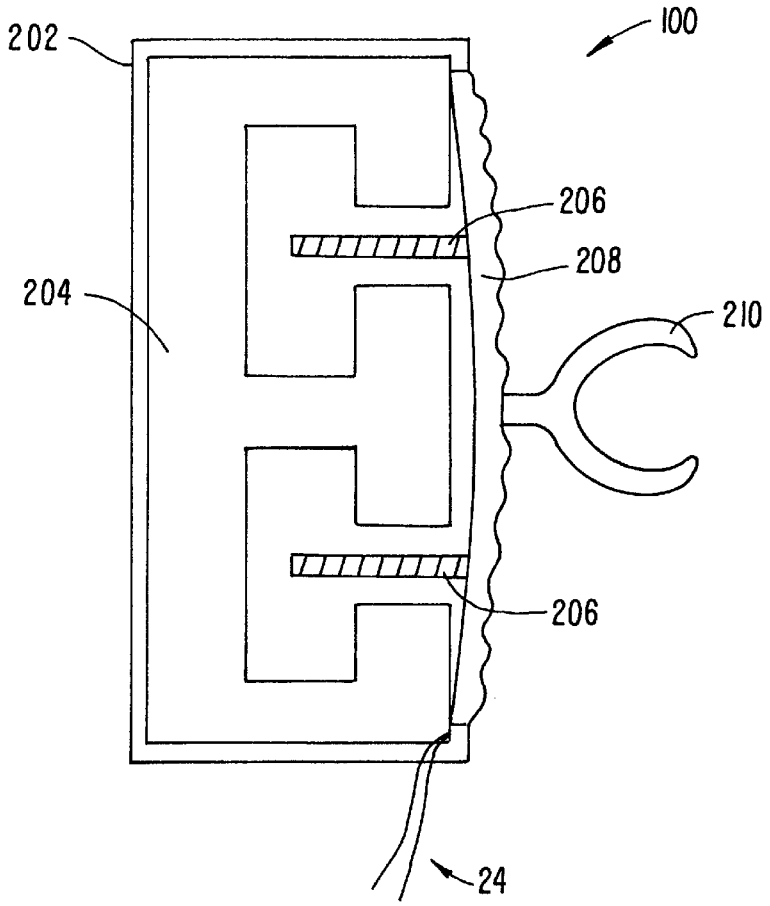
FIG. 9A is a cross-sectional view of an embodiment of a floating mass transducer having a floating coil.
Figure 9B:
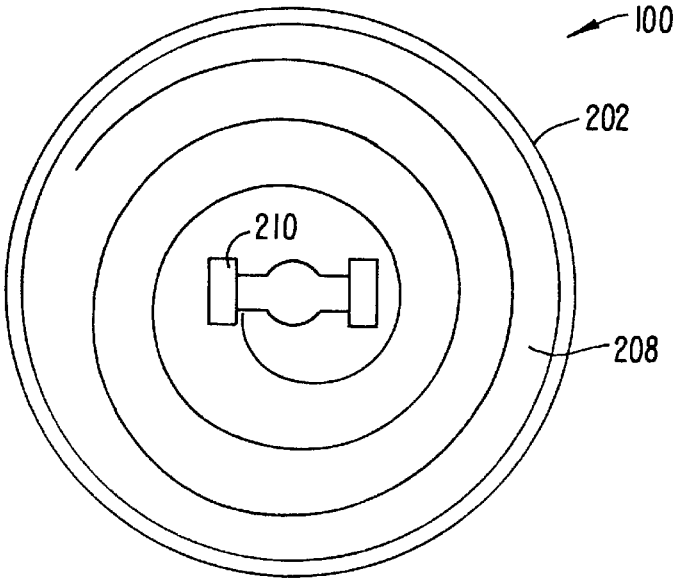
FIG. 9B is a side view of the floating mass transducer of FIG. 9A.

The structure of another embodiment of a floating mass transducer according to the present invention is shown in FIGS. 9A and 9B. Unlike the previous embodiment, the floating mass in this embodiment is the coil. The transducer 100 is generally comprised of a housing 202 having a magnet assembly 204 and a coil 206 disposed inside it. The housing is generally a cylindrical capsule with one end open which is sealed by a flexible diaphragm 208. The magnet assembly may include a permanent magnet and associated pole pieces to produce a substantially uniform flux field as was described previously in reference to FIG. 5. The magnet assembly is secured to the housing, and the coil is secured to flexible diaphragm 208. The diaphragm is shown having a clip 210 attached to center of the diaphragm which allows the transducer to be attached to the incus.

The coil is electrically connected to an external power source (not shown) which provides alternating current to the coil through leads 24. When alternating current is conducted to the coil, the coil and magnet assembly oscillate relative to each other causing the diaphragm to vibrate. Preferably, the relative vibration of the coil and diaphragm is substantially greater than the vibration of the magnet assembly and housing.

Figure 10:
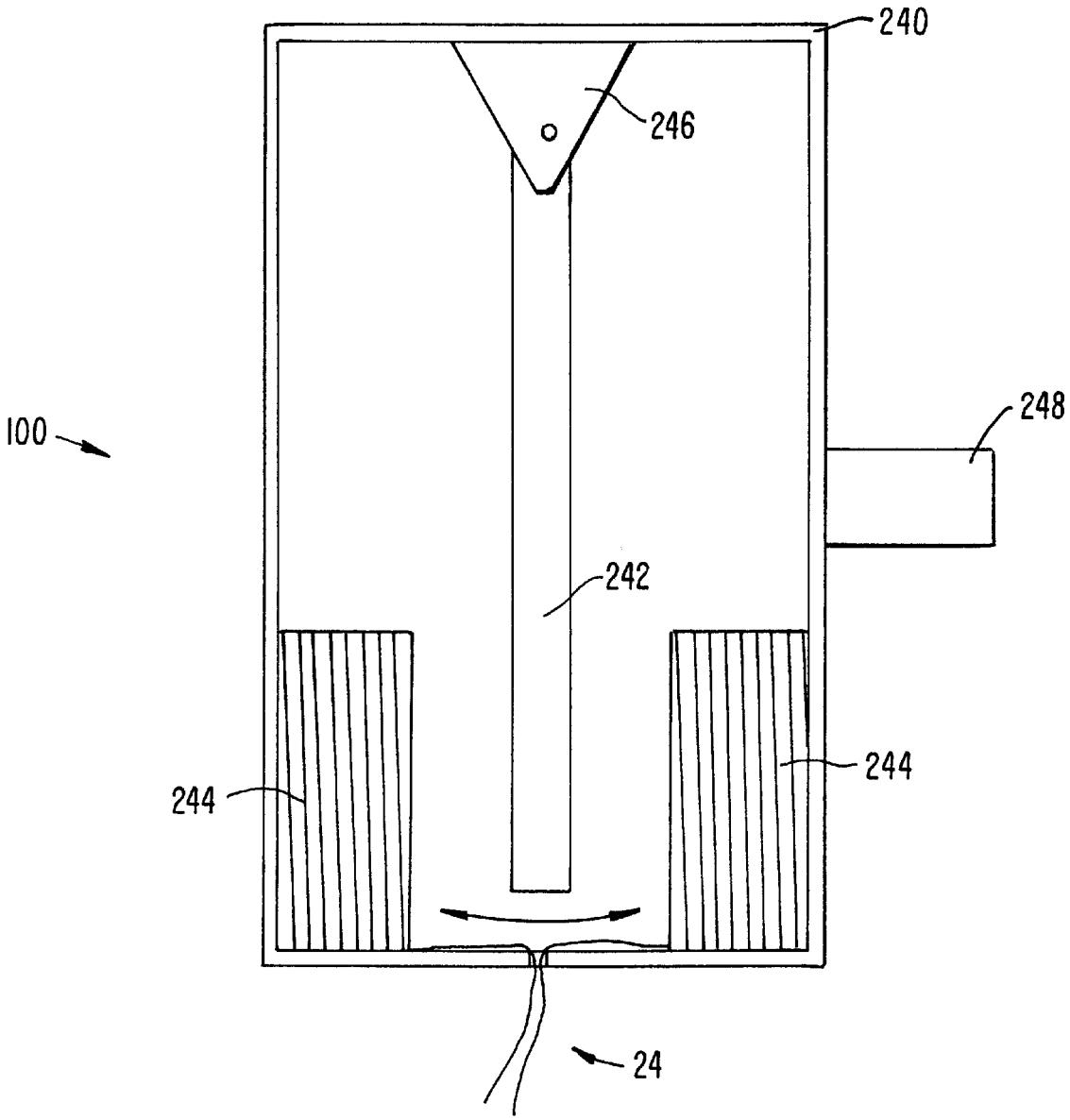
FIG. 10 is a cross-sectional view of an embodiment of a floating mass transducer having a angular momentum mass magnet.

The structure of another embodiment of a floating mass transducer according to the present invention is shown in FIG. 10. In this embodiment, the mass swings like a pendulum through an arc. The transducer 100 is generally comprised of a housing 240 having a magnet 242 and coils 244 disposed inside it. The housing is generally a sealed rectangular capsule. The magnet is secured to the housing by being rotatably attached to a support 246. The support is secured to the inside of the housing and allows the magnet to swing about an axis within the housing. Coils 244 are secured within the housing.

The coils are electrically connected to an external power source (not shown) which provides alternating current to the coils through leads 24. When current is conducted to the coils, one coil creates a magnetic field that attracts magnet 242 while the other coil creates a magnetic field that repels magnet 242. An alternating current will cause the magnet to vibrate relative to the coil and housing. A clip 248 is shown that may be used to attach the housing to an ossicle. Preferably, the relative vibration of the coils and housing is substantially greater than the vibration of the magnet.

Figure 11:
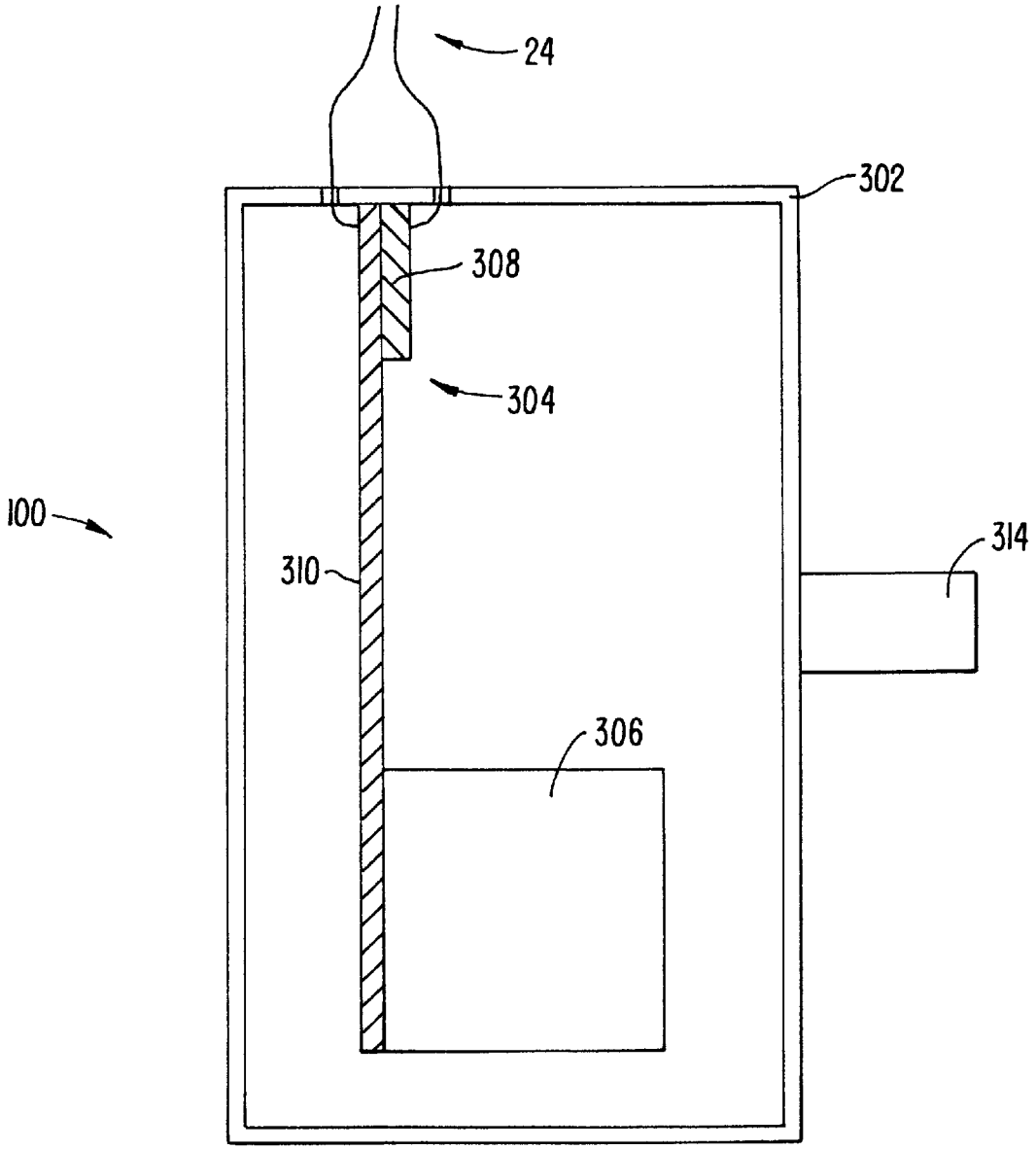
FIG. 11 is a cross-sectional view of an embodiment of a floating mass transducer having a piezoelectric element.

The structure of a piezoelectric floating mass transducer according to the present invention is shown in FIG. 11. In this embodiment, the floating mass is caused to vibrate by a piezoelectric bimorph. A transducer 100 is generally comprised of a housing 302 having a bimorph assembly 304 and a driving weight 306 disposed inside it. The housing is generally a sealed rectangular capsule. One end of the bimorph assembly 304 is secured to the inside of the housing and is composed of a short piezoelectric strip 308 and a longer piezoelectric strip 310. The two strips are oriented so that one strip contracts while the other expands when a voltage is applied across the strips through leads 24.

Driving weight 306 is secured to one end of piezoelectric strip 310 (the "cantilever"). When alternating current is conducted to the bimorph assembly, the housing and driving weight oscillate relative to each other causing the housing to vibrate. Preferably, the relative vibration of the housing is substantially greater than the vibration of the driving weight. A clip may be secured to the housing which allows the transducer to be attached to the incus.

Figure 12:
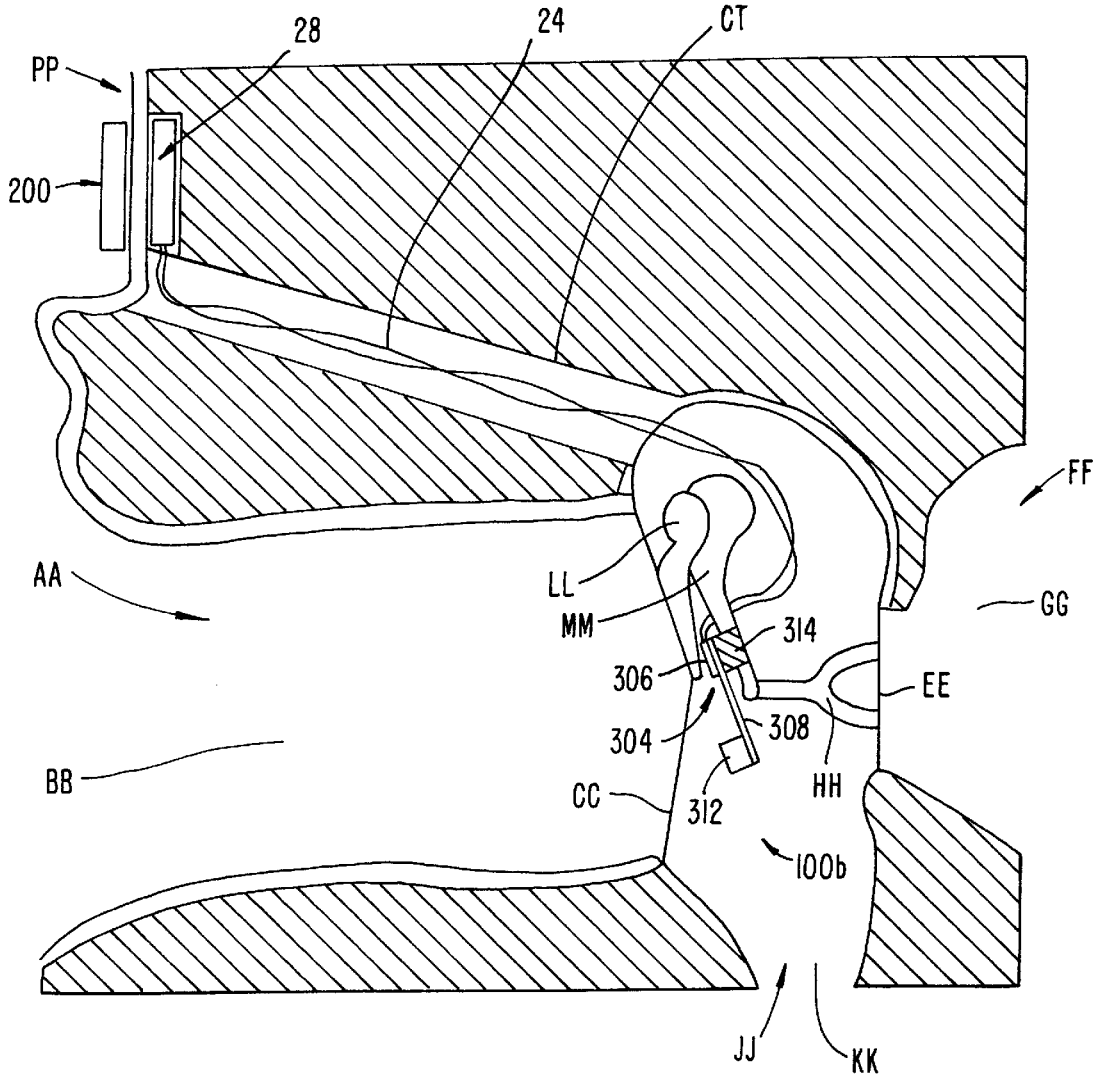
FIG. 12 is a schematic representation of a portion of the auditory system showing a floating mass transducer having a piezoelectric element positioned for receiving alternating current from a subcutaneous coil inductively coupled to an external sound transducer positioned outside a patient's head.

In another embodiment, the piezoelectric bimorph assembly and driving mass are not within a housing. Although the floating mass is caused to vibrate by a piezoelectric bimorph, the bimorph assembly is secured directly to an ossicle (e.g., the incus MM) with a clip as shown in FIG. 12. A transducer 100*b* has a bimorph assembly 304 composed of a short piezoelectric strip 306 and a longer piezoelectric strip 308. As before, the two strips are oriented so that one strip contracts while the other expands when a voltage is applied across the strips through leads 24. One end of the bimorph assembly is secured to a clip 314 which is shown fastened to the incus. A driving weight 312 is secured to the end of piezoelectric strip 308 opposite the clip in a position that does not contact the ossicles or surrounding tissue. Preferably, the mass of the driving weight is chosen so that all or a substantial portion of the vibration created by the transducer is transmitted to the incus.

Although the bimorph piezoelectric strips have been shown with one long portion and one short portion. The whole cantilever may be composed of bimorph piezoelectric strips of equal lengths.

Figure 13A:
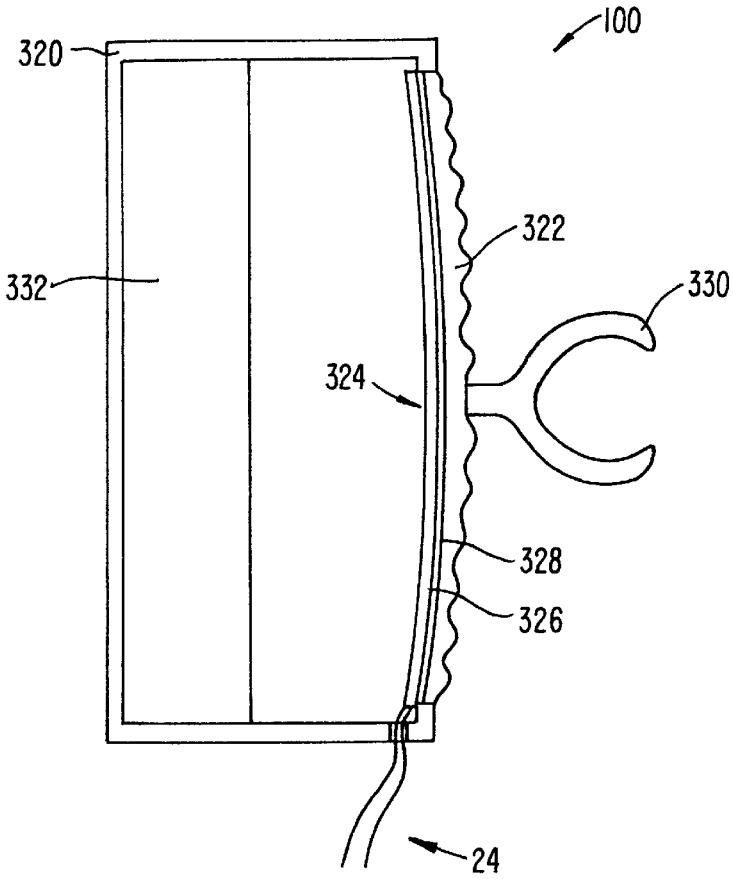
FIG. 13A is a cross-sectional view of an embodiment of a floating mass transducer having a thin membrane incorporating a piezoelectric strip.
Figure 13B:
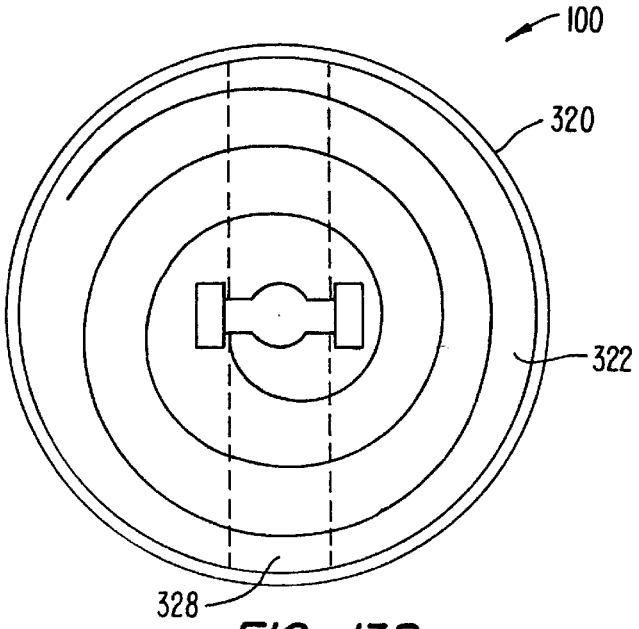
FIG. 13B is a side view of the floating mass transducer of FIG. 13A.

The structure of another embodiment of a floating mass transducer according to the present invention is shown in FIGS. 13A and 13B. In this embodiment, the floating mass is cause to vibrate by a piezoelectric bimorph in association with a thin membrane. The transducer 100 is comprised of a housing 320 which is generally a cylindrical capsule with one end open which is sealed by a flexible diaphragm 322. A bimorph assembly 324 is disposed within the housing and secured to the flexible diaphragm. The bimorph assembly is includes two piezoelectric strips 326 and 328. The two strips are oriented so that one strip contracts while the other expands when a voltage is applied across the strips through leads 24. The diaphragm is shown having a clip 330 attached to center of the diaphragm which allows the transducer to be attached to an ossicle.

When alternating current is conducted to the bimorph assembly, the diaphragm vibrates. Preferably, the relative vibration of the bimorph assembly and diaphragm is substantially greater than the vibration of the housing.

Figure 14:
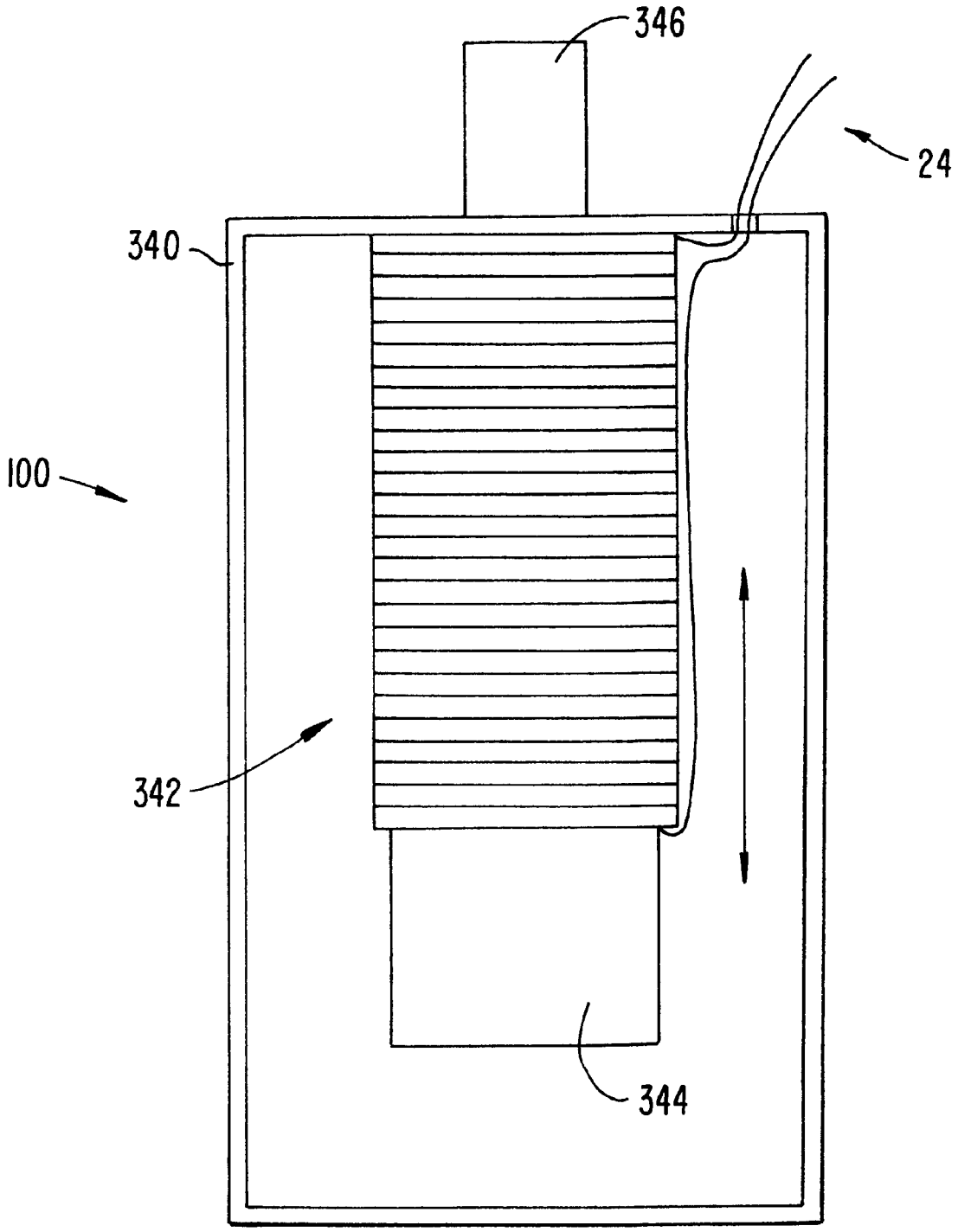
FIG. 14 is a cross-sectional view of an embodiment of a floating mass transducer having a piezoelectric stack.

The structure of a piezoelectric floating mass transducer according to the present invention is shown in FIG. 14. In this embodiment, the floating mass is caused to vibrate by a stack of piezoelectric strips. A transducer 100 is generally comprised of a housing 340 having a piezoelectric stack 342 and a driving weight 344 disposed inside it. The housing is generally a sealed rectangular capsule.

The piezoelectric stack is comprised of multiple piezoelectric sheets. One end of piezoelectric stack 340 is secured to the inside of the housing. Driving weight 344 is secured to the other end of the piezoelectric stack. When a voltage is applied across the piezoelectric strips through leads 24, the individual piezoelectric strips expand or contract depending on the polarity of the voltage. As the piezoelectric strips expand or contract, the piezoelectric stack vibrates along the double headed arrow in FIG. 16.

When alternating current is conducted to the piezoelectric stack, the driving weight vibrates causing the housing to vibrate. Preferably, the relative vibration of the housing is substantially greater than the vibration of the driving weight. A clip 346 may be secured to the housing to allow the transducer to be attached to an ossicle.

Figure 15:
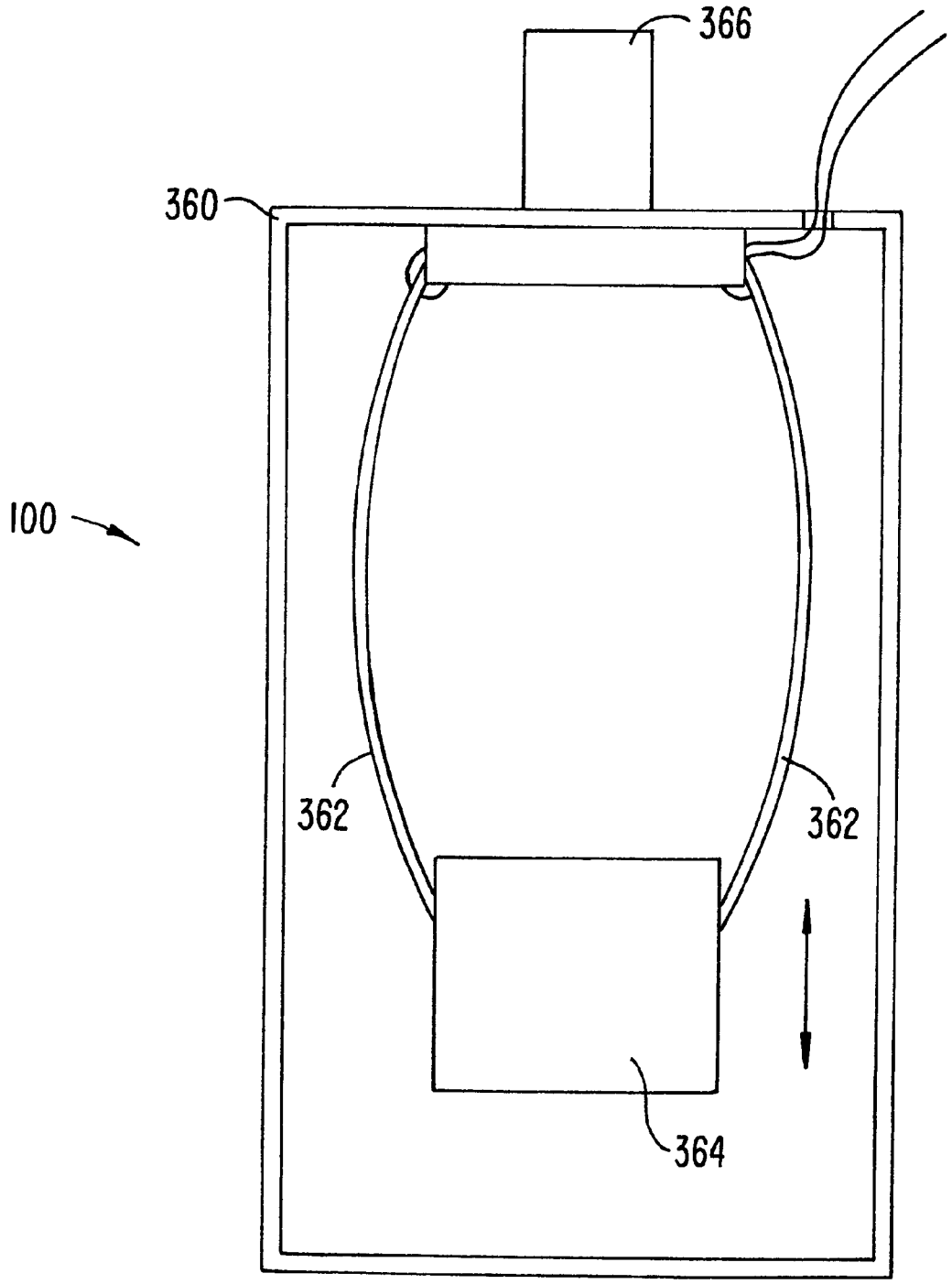
FIG. 15 is a cross-sectional view of an embodiment of a floating mass transducer having dual piezoelectric strips.

The structure of a piezoelectric floating mass transducer according to the present invention is shown in FIG. 15. In this embodiment, the floating mass is caused to vibrate by dual piezoelectric strips. A transducer 100 is generally comprised of a housing 360 having piezoelectric strips 362 and a driving weight 364 disposed inside it. The housing is generally a sealed rectangular capsule.

One end of each of the piezoelectric strips is secured to the inside of the housing. Driving weight 364 is secured to the other end of each of the piezoelectric strips. When a voltage is applied across the piezoelectric strips through leads 24, the piezoelectric strips expand or contract depending on the polarity of the voltage. As the piezoelectric strips expand or contract, the driving weight vibrates along the double headed arrow in FIG. 15.

When alternating current is conducted to the piezoelectric strips, the driving weight vibrates causing the housing to vibrate. Preferably, the relative vibration of the housing is substantially greater than the vibration of the driving weight. A clip 366 may be secured to the housing to allow the transducer to be attached to an ossicle. This embodiment has been described as having two piezoelectric strips. However, more than two piezoelectric strips may also be utilized.

An ultrasonic hearing system having a floating mass transducer may also be implanted to be fully internal. In this implementation, a floating mass transducer is secured within the middle or inner ear using at least one of the methods described above. A difficulty encountered when trying to produce a fully internal hearing system is to make the microphone function effectively. However, the floating mass transducer can also effectively function as an internal microphone.

Figure 16:
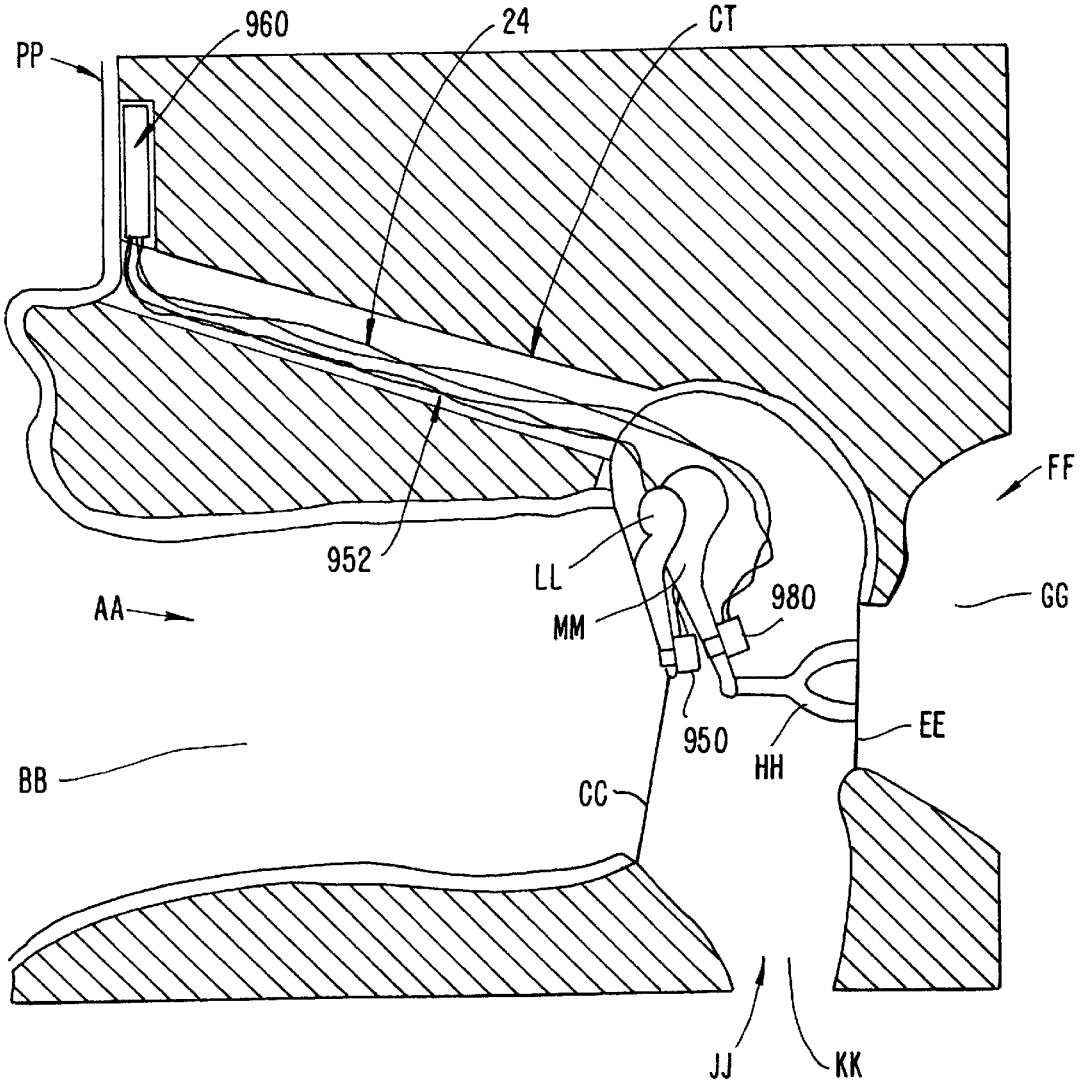
FIG. 16 is a schematic representation of a portion of the auditory system showing a fully internal ultrasonic hearing system incorporating floating mass transducers.

As an example of the operation of the fully internal device, FIG. 16 illustrates a fully internal ultrasonic hearing system utilizing a floating mass transducer. A floating mass transducer 950 is attached by a clip to the malleus LL. Transducer 950 picks up vibration from the malleus and produces an alternating current signal on leads 952. Therefore, transducer 950 is the equivalent of an internal microphone.

A sound processor 960 comprises a battery, amplifier, and signal processor, none shown in detail. The sound processor receives the signal and sends an amplified signal to a floating mass transducer 980 via leads 24. Transducer 980 is attached to the middle ear (e.g., the incus) to produce ultrasonic vibrations on the oval window that the patient can perceive.

In a preferred embodiment, the sound processor includes a rechargeable battery that is recharged with a pickup coil. The battery is recharged when a recharging coil having a current flowing through it is placed in close proximity to the pickup coil. Preferably, the volume of the sound processor may be remotely programmed such as being adjustable by magnetic switches which are set by placing a magnet in close proximity to the switches.

While the above is a complete description of preferred embodiments of the invention, various alternatives, modifications and equivalents may be used. It should be evident that the present invention is equally applicable by making appropriate modifications to the embodiments described above. For example, the above embodiments have discussed using only a single ultrasonic FMT 100; it may be advantageous to use two or more FMTs to better communicate the ultrasonic signal with or near the inner ear structure. Therefore, the above description should not be taken as limiting the scope of the invention which is defined by the metes and bounds of the appended claims along with their full scope of equivalents.

What is claimed is:

1. A hearing device for providing a vibration to a portion of the human ear comprising:

a housing arranged to be mounted on a human body; and a magnet disposed within said housing, wherein said magnet is arranged to vibrate relative to the housing in direct response to an externally generated ultrasonic frequency electric signal so as to cause said housing to vibrate ultrasonically thereby, in use, to enhance a sense of hearing of the human body.

2. The hearing device as in claim 1, further comprising a biasing mechanism which supports the magnet within the housing, said magnet being free to move within said housing subject to the retention provided by said biasing mechanism, wherein said vibration is tuned to the ultrasonic frequency which corresponds to a level of retention.

3. The hearing device as in claim 2, wherein said level of retention corresponds to the resiliency characteristic of said biasing mechanism.

4. The hearing device as in claim 2, wherein the biasing mechanism comprises an elastomeric material.

5. The hearing device as in claim 4, wherein the elastomeric material is taken from the group consisting of unfilled silicone, urethane, and natural latex rubber.

6. The hearing device as in claim 2, wherein the biasing mechanism has a combined dynamic spring force of between about 100 kN/m and about 500 kN/m.

7. The hearing device as in claim 2, wherein the biasing mechanism has a damping ratio of between about 0.01 N-s/m and about 1 N-s/m.

8. The hearing device as in claim 2, wherein the biasing mechanism comprises a coil spring, said coil spring having a combined dynamic spring force of between about 100 kN/m and about 500 kN/m.

9. The hearing device as in claim 1, wherein the ultrasonic frequency is greater than 20,000 Hz.

10. The hearing device as in claim 1, wherein said housing is adapted to be coupled to a vibratory component of an ear of a human.

11. A hearing device for providing a signal to a portion of the human ear comprising:

a housing;

at least one coil coupled to the housing;

a magnet within the housing, wherein said magnet vibrates in direct response to a n externally generated electric signal through the at least one coil; and a biasing mechanism which supports the magnet within the housing, said magnet being free to move within said housing subject to the retention provided by said biasing mechanism, wherein said vibration is tuned to an ultrasonic vibration in direct response to said retention which causes said housing to ultrasonic ally vibrate.

12. An ultrasonic hearing system comprising:

a microphone for receiving an acoustic signal and converting said acoustic signal to an electric signal;

a frequency transposition device for converting said electrical signal to an ultrasonic frequency signal; and a transducer for converting said ultrasonic frequency signal to an ultrasonic inertial vibration;

wherein said transducer is adapted to be coupled to a vibratory component of an ear of a human.

13. The system of claim 12, further comprising an amplifier.

14. The system of claim 12, further comprising a signal processor for modification of said electric al signal.

15. The system of claim 12, wherein said transducer is implantable.

16. The system of claim 12, wherein each element of said ultrasonic hearing system is totally implantable.

17. The system of claim 12, wherein said vibratory component of an ear of a human comprises a component taken from the group of human ear components consisting of the vestibular system, the saccular system, the cochlear system, and the bone conduction system of the human ear.

18. A process for ultrasonic hearing comprising converting an ultrasonic frequency electrical signal to an ultrasonic inertial vibration using a transducer, said transducer adapted to be coupled to a component of an ear of a human.

19. A process for ultrasonic hearing comprising:

receiving an acoustic signal;

converting said acoustic signal to an electric signal;

converting said electrical signal to an ultrasonic frequency; and converting said ultrasonic frequency to an ultrasonic inertial vibration using a transducer, said transducer adapted to be coupled to a component of an inner ear of a human.

20. An improved ultrasonic hearing system of the type including (a) a microphone for receiving an acoustic signal and converting said acoustic signal to an electric signal; and (b) a frequency transposition device for converting said electrical signal to an ultrasonic frequency signal, wherein the improvement comprises:

a transducer for converting said ultrasonic frequency signal to an ultrasonic inertial vibration, wherein said transducer is adapted to be coupled to a vibratory component of an ear of a human.

21. An improved hearing device of the type including a housing and a magnet, disposed within said housing, wherein said magnet vibrates said housing in direct response to an externally generated electric signal; the improvement comprising:

a means for tuning a resonance of said hearing device such that said housing vibrates ultrasonically.

22. The hearing device as in claim 21, wherein said means comprises a biasing mechanism which supports the magnet within the housing, wherein a resiliency of said biasing mechanism can be configured so that said housing vibrates at an ultrasonic frequency.

23. The hearing device as in claim 21, wherein said housing is adapted to be coupled to a vibratory component of an ear of a human.

* * * * *